US011394094B2

(12) United States Patent
Kamgaing et al.

(10) Patent No.: US 11,394,094 B2
(45) Date of Patent: Jul. 19, 2022

(54) WAVEGUIDE CONNECTOR HAVING A CURVED ARRAY OF WAVEGUIDES CONFIGURED TO CONNECT A PACKAGE TO EXCITATION ELEMENTS

(71) Applicant: Intel Corporation, Santa Clara, CA (US)

(72) Inventors: Telesphor Kamgaing, Chandler, AZ (US); Sasha Oster, Marion, IA (US); Georgios Dogiamis, Chandler, AZ (US); Adel Elsherbini, Chandler, AZ (US); Shawna Liff, Scottsdale, AZ (US); Aleksandar Aleksov, Chandler, AZ (US); Johanna Swan, Scottsdale, AZ (US); Brandon Rawlings, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/328,524

(22) PCT Filed: Sep. 30, 2016

(86) PCT No.: PCT/US2016/054900

§ 371 (c)(1),
(2) Date: Feb. 26, 2019

(87) PCT Pub. No.: WO2018/063367

PCT Pub. Date: Apr. 5, 2018

(65) Prior Publication Data

US 2019/0190106 A1 Jun. 20, 2019

(51) Int. Cl.

*H01P 1/04* (2006.01)
*H01P 1/02* (2006.01)
(Continued)

(52) U.S. Cl.

CPC ..... *H01P 1/042* (2013.01); *H01P 1/022* (2013.01); *H01P 3/121* (2013.01); *H01P 3/122* (2013.01); *H01P 11/002* (2013.01); *H01P 3/12* (2013.01)

(58) Field of Classification Search

CPC ..... H01P 1/022; H01P 1/042; H01P 5/024; H01P 5/087; H01P 3/122; H01P 3/16; H01P 11/002; H01P 11/006
(Continued)

(56) References Cited

U.S. PATENT DOCUMENTS 4,853,704 A 8/1989 Diaz et al.
4,882,553 A 11/1989 Davies et al.
(Continued)

FOREIGN PATENT DOCUMENTS

EP 0257881 3/1988
JP 2007235563 9/2007
(Continued)

OTHER PUBLICATIONS

Office Action from related matter U.S. Appl. No. 16/328,532 dated Apr. 3, 2020.
(Continued)

*Primary Examiner* — Benny T Lee
(74) *Attorney, Agent, or Firm* — Schwabe, Williamson & Wyatt, P.C.

(57) ABSTRACT

Generally, this disclosure provides apparatus and systems for coupling waveguides to a server package with a modular connector system, as well as methods for fabricating such a connector system. Such a system may be formed with connecting waveguides that turn a desired amount, which in turn may allow a server package to send a signal through a waveguide bundle in any given direction without bending waveguides.

19 Claims, 20 Drawing Sheets

(51) Int. Cl.
*H01P 3/12* (2006.01)
*H01P 11/00* (2006.01)

(58) Field of Classification Search
USPC ..... 333/248, 254, 1
See application file for complete search history.

(56) References Cited

U.S. PATENT DOCUMENTS

| | | | | |
|---|---|---|---|---|
| 5,036,335 | A | 7/1991 | Jairam | |
| 5,264,860 | A | 11/1993 | Quan | |
| 5,545,924 | A | 8/1996 | Contolatis et al. | |
| 5,557,291 | A | 9/1996 | Chu et al. | |
| 5,825,333 | A | 10/1998 | Kudoh et al. | |
| 6,292,153 | B1 | 9/2001 | Aielli et al. | |
| 6,317,094 | B1 | 11/2001 | Wu et al. | |
| 6,538,614 | B2 | 3/2003 | Fleming et al. | |
| 6,867,742 | B1 | 3/2005 | Irion, II et al. | |
| 7,057,570 | B2 | 6/2006 | Irion | |
| 7,471,165 | B2 | 12/2008 | Asamura et al. | |
| 7,652,631 | B2 | 1/2010 | McGrath | |
| 9,142,889 | B2 | 9/2015 | Pazin et al. | |
| 9,960,849 | B1 | 5/2018 | Dogiamis et al. | |
| 10,249,925 | B2 | 3/2019 | Elsherbini et al. | |
| 10,256,521 | B2 | 4/2019 | Elsherbini et al. | |
| 10,263,312 | B2 | 4/2019 | Elsherbini et al. | |
| 10,461,388 | B2 | 10/2019 | Kamgaing et al. | |
| 2002/0186105 | A1 | 12/2002 | Shih et al. | |
| 2003/0137465 | A1 | 7/2003 | Graczyk et al. | |
| 2003/0169965 | A1 | 9/2003 | Tadahiki | |
| 2003/0187572 | A1 | 10/2003 | Ammar | |
| 2004/0069984 | A1 | 4/2004 | Estes et al. | |
| 2005/0012199 | A1 | 1/2005 | Rosenau et al. | |
| 2005/0012672 | A1 | 1/2005 | Fisher | |
| 2007/0031083 | A1 | 2/2007 | Logvin | |
| 2008/0136689 | A1 | 6/2008 | Gonzalez | |
| 2008/0160931 | A1 | 7/2008 | Rofougaran | |
| 2008/0211726 | A1 | 9/2008 | Elsallal et al. | |
| 2008/0224936 | A1 | 9/2008 | Brist et al. | |
| 2010/0053026 | A1 | 3/2010 | Van Der Poel | |
| 2010/0302544 | A1 | 12/2010 | Duer | |
| 2011/0018657 | A1 | 1/2011 | Cheng et al. | |
| 2011/0102284 | A1 | 5/2011 | Brown et al. | |
| 2011/0267249 | A1 | 11/2011 | Miyata | |
| 2012/0013499 | A1* | 1/2012 | Hayata | H01P 5/107 342/112 |
| 2012/0176285 | A1 | 7/2012 | Morgia | |
| 2013/0082800 | A1 | 4/2013 | Rogougaran et al. | |
| 2013/0120206 | A1 | 5/2013 | Biancotto et al. | |
| 2014/0085156 | A1 | 3/2014 | Gebretnsae et al. | |
| 2014/0218251 | A1 | 8/2014 | Waschenko et al. | |
| 2014/0291835 | A1 | 10/2014 | Demin et al. | |
| 2014/0355663 | A1 | 12/2014 | Kizer et al. | |
| 2015/0029069 | A1 | 1/2015 | Roemer et al. | |
| 2015/0048471 | A1 | 2/2015 | Hasch et al. | |
| 2015/0109739 | A1 | 4/2015 | Shapiro et al. | |
| 2015/0260916 | A1 | 9/2015 | Cherchi et al. | |
| 2015/0364830 | A1 | 12/2015 | Tong et al. | |
| 2016/0043455 | A1 | 2/2016 | Seler et al. | |
| 2016/0142155 | A1 | 5/2016 | Kim et al. | |
| 2016/0153040 | A1 | 6/2016 | Zhong et al. | |
| 2017/0047312 | A1 | 2/2017 | Budd et al. | |
| 2017/0207510 | A1* | 7/2017 | Park et al. | H01P 3/165 |
| 2017/0271738 | A1* | 9/2017 | Smith, Jr. et al. | H01P 5/107 |
| 2017/0324135 | A1 | 11/2017 | Blech et al. | |
| 2018/0052281 | A1 | 2/2018 | Kuo et al. | |
| 2018/0090803 | A1 | 3/2018 | Elsherbini et al. | |
| 2018/0090848 | A1 | 3/2018 | Elsherbini et al. | |
| 2018/0097268 | A1 | 4/2018 | Oster et al. | |
| 2018/0097269 | A1 | 4/2018 | Dogiamis et al. | |
| 2018/0183561 | A1 | 6/2018 | Dogiamis et al. | |
| 2019/0173149 | A1 | 6/2019 | Elsherbini et al. | |
| 2019/0190106 | A1 | 6/2019 | Kamgaing et al. | |
| 2019/0190119 | A1 | 6/2019 | Oster et al. | |
| 2019/0198961 | A1 | 6/2019 | Aleksov et al. | |
| 2019/0198965 | A1 | 6/2019 | Kemgaing et al. | |
| 2019/0200451 | A1 | 6/2019 | Elsherbini et al. | |
| 2019/0207290 | A1 | 7/2019 | Rawlings et al. | |

FOREIGN PATENT DOCUMENTS

| | | |
|---|---|---|
| WO | 2012-040376 | 3/2012 |
| WO | 2015-157548 | 10/2015 |
| WO | 2018057006 | 3/2018 |
| WO | 2018-063238 | 4/2018 |
| WO | 2018-063341 | 4/2018 |
| WO | 2018-063342 | 4/2018 |
| WO | 2018-063362 | 4/2018 |
| WO | 2018-063388 | 5/2018 |

OTHER PUBLICATIONS

Office Action from related U.S. Appl. No. 15/277,504, dated Jun. 12, 2019.
Office Action from related U.S. Appl. No. 15/277,504, dated Sep. 10, 2018.
Final Office Action from related U.S. Appl. No. 15/277,504, dated Feb. 28, 2019.
International Search Report and Written Opinion from related application PCT/US2016/054417 dated Jun. 20, 2017.
International Preliminary Report on Patentability from related application PCT/US2016/054417 dated Feb. 4, 2019.
International Search Report and Written Opinion from related matter PCT/US16/053491 dated Apr. 25, 2017.
International Preliminary Report on Patentability from related matter PCT/US16/053491 dated Mar. 6, 2019.
International Search Report and Written Opinion from related matter PCT/US17/49173 dated Dec. 11, 2017.
International Preliminary Report on Patentability from related matter PCT/US17/49173 dated Apr. 2, 2019.
International Search Report and Written Opinion from related application PCT/US17/48755 dated Dec. 14, 2017.
International Preliminary Report on Patentability from related application PCT/US17/48755 dated Apr. 2, 2019.
International Search Report and Written Opinion issued in PCT Application No. PCT/US2016/053463, dated Apr. 25, 2017.
International Preliminary Report on Patentability issued in PCT Application No. PCT/US2016/053463, dated Apr. 4, 2019.
Office Action issued in U.S. Appl. No. 15/280,823, dated Jun. 14, 2018.
International Search Report and Written Opinion from related application PCT/US2017/063600 dated Mar. 8, 2018.
International Preliminary Report on Patentability from related application PCT/US2017/063600 dated Jul. 11, 2019.
Office Action from related matter U.S. Appl. No. 15/394,990 dated Apr. 2, 2017.
Office Action from related matter U.S. Appl. No. 15/394,990 dated Oct. 4, 2018.
Office Action from related matter U.S. Appl. No. 15/394,990 dated Mar. 4, 2019.
International Search Report and Written Opinion received in International PCT Application PCT/US2016/054900 dated Apr. 25, 2017.
International Search Report and Written Opinion received in International PCT Application PCT/US2016/054900 dated Apr. 2, 2019.

* cited by examiner

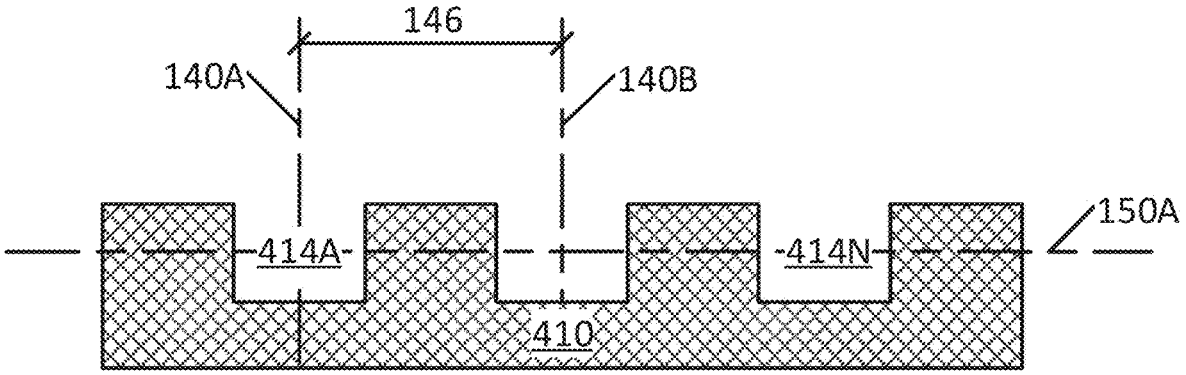
Figure 4A
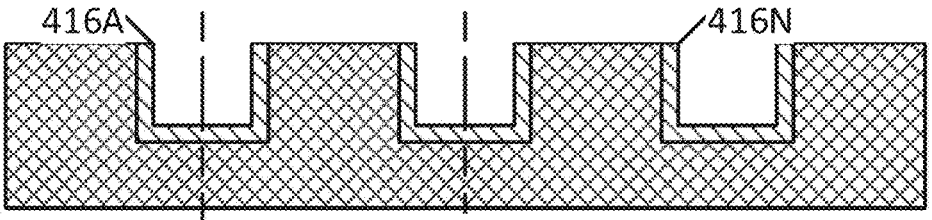
Figure 4B
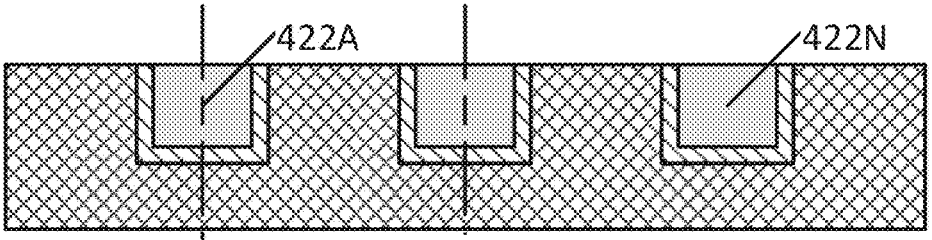
Figure 4C
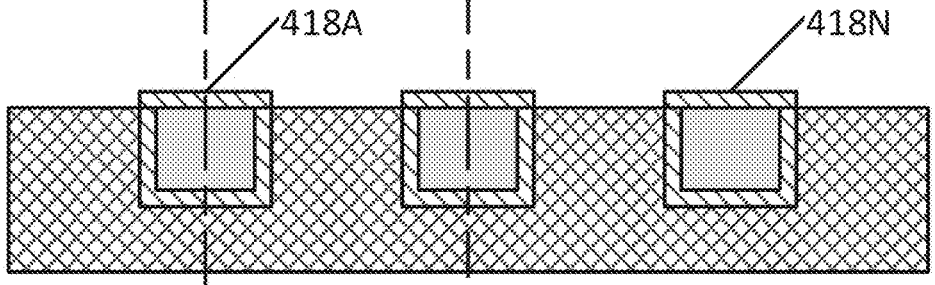
Figure 4D
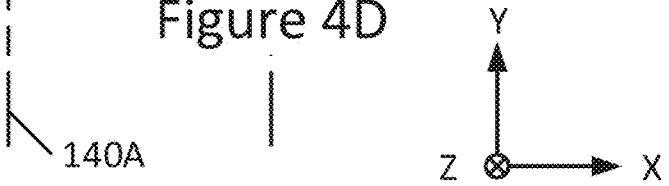

WAVEGUIDE CONNECTOR HAVING A CURVED ARRAY OF WAVEGUIDES CONFIGURED TO CONNECT A PACKAGE TO EXCITATION ELEMENTS

CROSS-REFERENCE TO THE RELATED APPLICATIONS

This patent application is a U.S. National Phase Application under 35 U.S.C. § 371 of International Application No. PCT/US2016/054900, filed on Sep. 30, 2016, the entire contents of which is hereby incorporated by reference herein.

TECHNICAL FIELD

The present disclosure relates to systems and methods for coupling waveguides to package substrates.

BACKGROUND

As more devices become interconnected and users consume more data, the demand placed on servers accessed by users has grown commensurately and shows no signs of letting up in the near future. Among others, these demands include increased data transfer rates, switching architectures that require longer interconnects, and extreme cost and power efficient solutions.

There are many interconnects within server and high performance computing (HPC) architectures today. These interconnects include within blade interconnects, within rack interconnects, and rack-to-rack interconnects or rack-to-switch interconnects. In today's architectures, short interconnects (for example, within rack interconnects and some rack-to-rack interconnects) are achieved with electrical cables—such as Ethernet cables, co-axial cables, or twin-axial cables, depending on the required data rate. For longer distances, optical solutions are employed due to the very long reach and high bandwidth enabled by fiber optic solutions. However, as new architectures emerge, such as 100 Gigabit Ethernet, traditional electrical connections are becoming increasingly expensive and highly power consuming to support the required data rates and transmission range. For example, to extend the reach of a cable or the given bandwidth on a cable, higher quality cables may need to be used or advanced equalization, modulation, and/or data correction techniques employed which add power and latency to the system. For some distances and data rates required in proposed architectures, there is no viable electrical solution today. Optical transmission over fiber is capable of supporting the required data rates and distances, but at a severe power and cost penalty, especially for short to medium distances, such as a few meters.

Waveguides have not been used in modern server and HPC architectures in part because the compact nature of these architectures require some degree of flexibility in the chosen interconnect methods. With modern assembly and implementation methods, when waveguides are bent, some cross-sectional deformation is common. As waveguides largely rely on a consistent cross-section for signal integrity, even slight deformation often results in levels of signal degradation that are unacceptable for most server and HPC applications. Also, as signal frequencies increase, waveguides' dimensions decrease. As dimensions decrease, alignment tolerances become stricter. Thus, using current systems and methods, optical waveguides are difficult to reliably and appropriately connect to their source at the scales these applications demand. Further, as data rates increase, signal degradation tolerances tend to decrease, so today's electrical waveguides and their assembly methods are trending to become even less feasible for these applications in the future.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts throughout the specification description, and in which:

FIG. 4A illustrates a cross-section of an example waveguide connector in accordance with at least one embodiment described herein;

FIG. 4B illustrates a cross-section of the waveguide connector of FIG. 4A, including added peripheral members;

FIG. 4C illustrates a cross-section of the waveguide connector of FIGS. 4A and 4B, including added sacrificial material;

FIG. 4D illustrates a cross-section of the waveguide connector of FIGS. 4A-4C, including added top members;

Figure 1A:
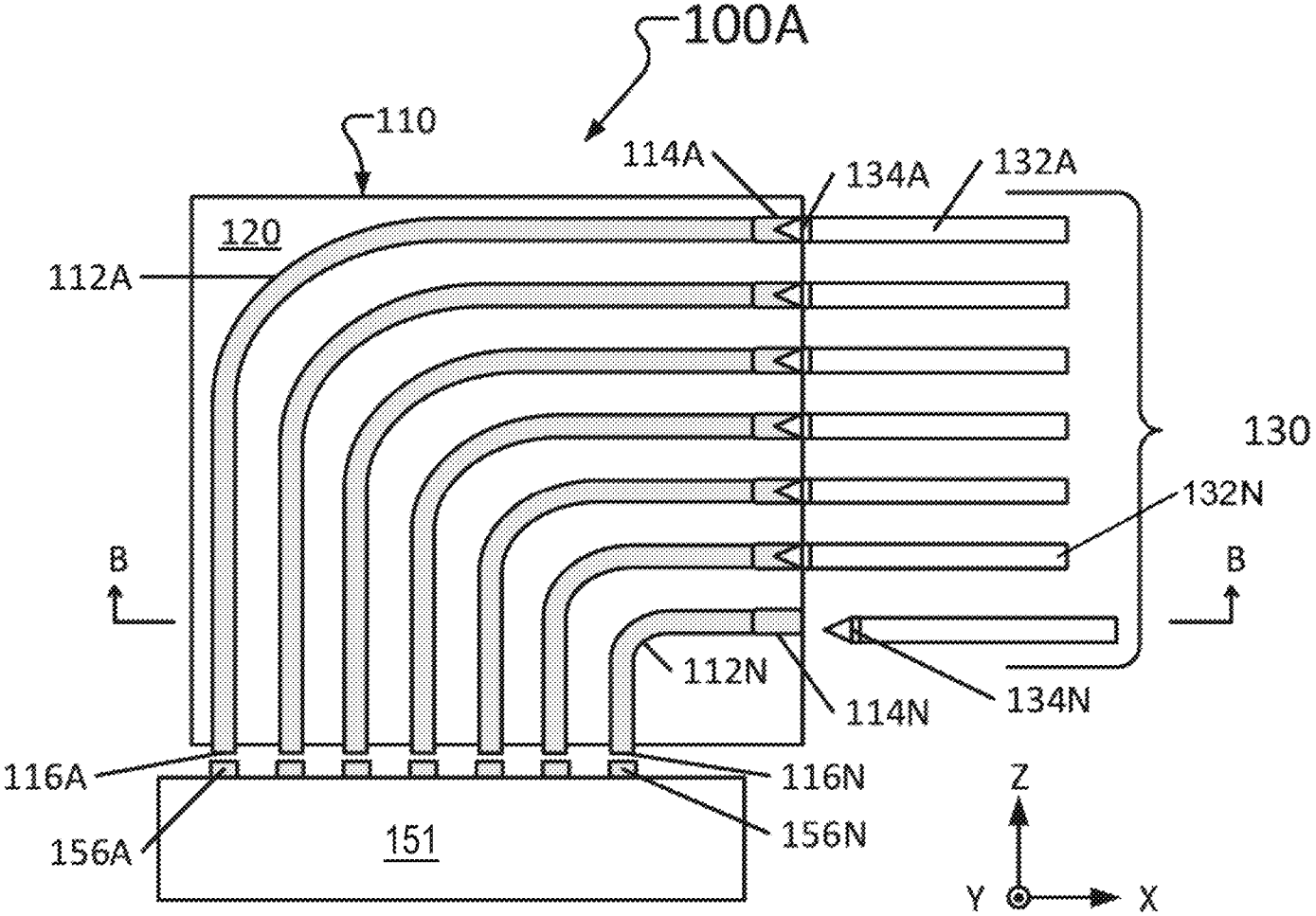
FIG. 1A illustrates a view of an example waveguide connector in accordance with at least one embodiment described herein.

Although the following Detailed Description will proceed with reference being made to illustrative embodiments, many alternatives, modifications and variations thereof will be apparent to those skilled in the art.

DETAILED DESCRIPTION OF THE INVENTION

Generally, this disclosure provides apparatus and systems for coupling waveguides to a server package with a modular connector system, as well as methods for fabricating such a connector system. Such a system may be formed with connecting waveguides that rotate through a desired angle, which in turn may allow a server package to send a signal through a waveguide bundle in any given direction without bending waveguides of the bundle.

A power-competitive data transmission means that can support very high data rates over short to medium distances would be extremely advantageous. The systems and methods disclosed herein provide waveguide connector systems and methods that may facilitate the transmission of data between blade servers ("blades") within a server rack or between collocated server racks using millimeter-waves (mm-waves) and sub-Terahertz (sub-THz) waves. For example, mm-waves are electromagnetic waves having frequencies from about 30 GHz to about 300 GHz, and sub-THz waves are electromagnetic waves having frequencies ranging from about 100 GHz to about 900 GHz. The waveguide connector systems disclosed herein may enable the coupling of one or more waveguide members to a package in a location proximate to the radio frequency ("RF") launchers or antennas carried by the package. The systems and methods disclosed herein may facilitate the coupling of one or more waveguides to the packages either individually or grouped together using a modular connector or similar device. Put simply, one embodiment of the system disclosed herein may effectively serve as a modular "joint" or adaptive connector between a package output and a waveguide bundle. This is advantageous because it allows waveguide bundle connections between packages without bending the bundle itself and without particularly realigning the packages. For example, using one of the systems disclosed herein at each end of a waveguide bundle may advantageously allow a straight-line waveguide bundle to connect two different packages whose input/output ports are not facing each other, without moving the packages.

The systems and methods disclosed herein may further facilitate the fabrication of modular waveguide connector systems. More particularly, the introduction of a printed fabrication method may allow nonlinear waveguides to be constructed or implemented without bending.

The terms "horizontal" and "vertical" as used in any embodiment herein are not used as terms of limitation, but merely as relative terms to simplify descriptions of components of those embodiments. The terms may be substituted or interchanged with no impact on the intended meaning or scope of the description of any embodiment. For example, a component described as vertical may be horizontal if the system to which the component is attached is rotated through an angle of 90°. The terms "row" and "column" are similarly used herein as relative terms for simplification purposes only, and may be substituted or interchanged with no impact on intended meaning or scope. The terms "first" and "second" are similarly used herein as relative terms for simplification purposes only, and may be substituted or interchanged with no impact on intended meaning or scope. The terms "height," "width" and "depth" are similarly used herein as relative terms for simplification purposes only, and may be substituted or interchanged with no impact on intended meaning or scope. The term "package" is used herein to describe a package substrate. The package may be any kind of package substrate including organic, plastic, ceramic, or silicon used for a semiconductor integrated circuit.

Some Figures include an XYZ compass to denote a 3-dimensional coordinate system. This is included and used for clarity and explanatory purposes only; the embodiments depicted are not intended to be limited by the inclusion or use of such a coordinate system. The labels or directions may be substituted or interchanged with no impact on intended meaning or scope.

Figure 1B:
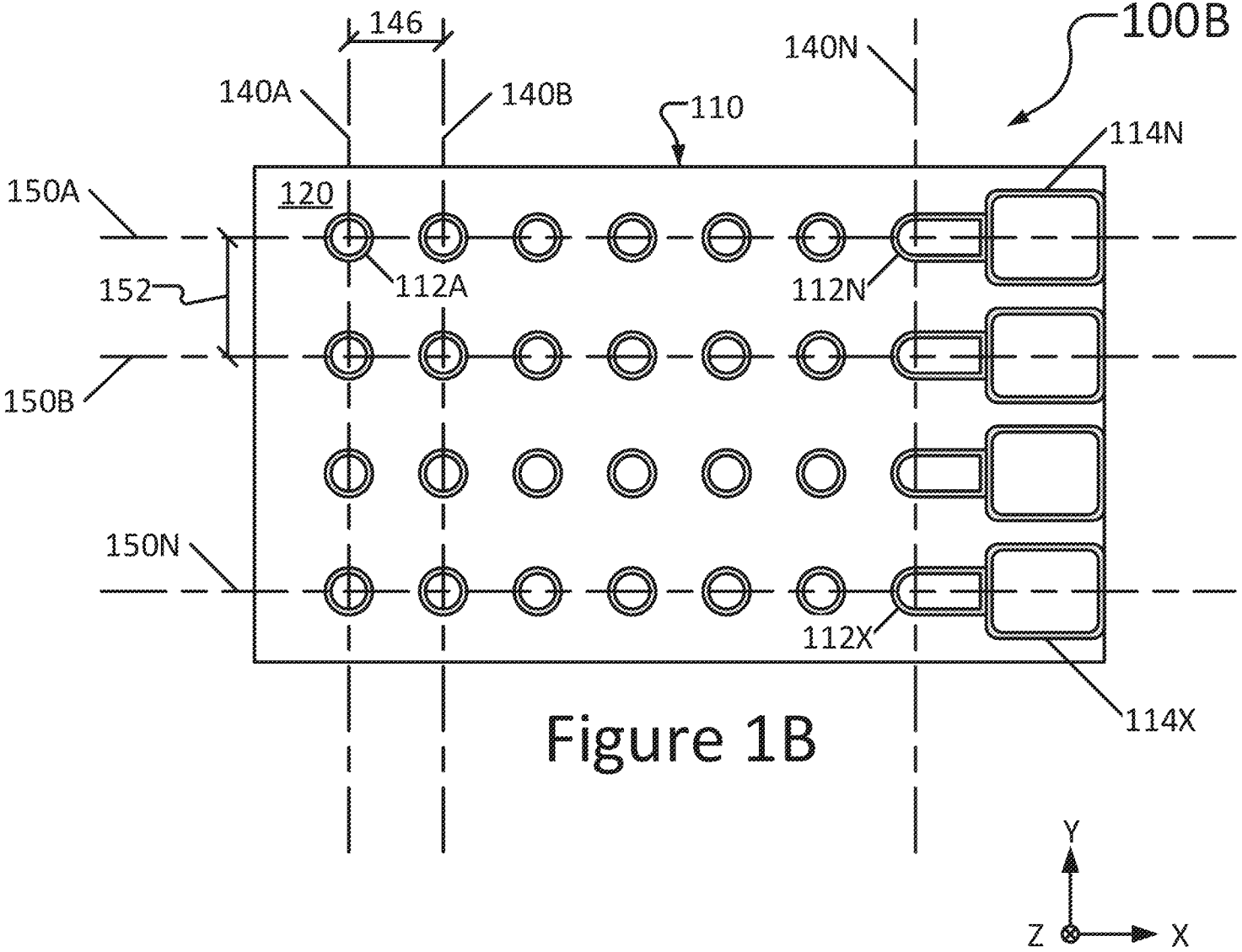
FIG. 1B illustrates a cross-section of the waveguide connector in FIG. 1A along sectional line B-B.

FIG. 1A illustrates a view 100A of an example waveguide connector 110 in accordance with at least one embodiment described herein. FIG. 1B illustrates a cross-section 100B of the waveguide connector 110 in FIG. 1A along sectional line B-B.

Turning to FIG. 1A, a first end of a waveguide connector 110 may be operably coupled to waveguide bundle 130 and/or a second end of the waveguide connector 110 may be operably coupled to a package, such as package 151. Package 151 may be any of a plurality of materials, such as organic materials (e.g., dielectric materials) sandwiched between metallic traces (e.g., copper). Waveguide connector 110 may include a housing 120 disposed about all or a portion of some or all of the one or more waveguides 112A, . . . , 112N (collectively referred to as "waveguides"). Waveguide bundle 130 may contain one or more external waveguides 132A, . . . 132N (collectively referred to as "external waveguides"). Package 151 may contain one or more launchers or excitation elements such as outputs 156A, . . . , 156N (collectively referred to as "package outputs"), capable of bidirectional or unidirectional communication with one or more external devices via a waveguide (such as one of external waveguides). Package outputs may also serve as package inputs at the same time, or at different times.

Waveguide connector 110 may be any of a plurality of dimensions. For example, waveguide connector 110 may have a height of about 1 centimeter (cm) or greater, a width of about 1 cm or greater and a depth of about 1 cm or greater.

However, any or all of these dimensions may vary; waveguide connector 110 may have a height of about 1.5 cm or greater, a width of about 0.5 cm or greater and a depth of about 20 cm or greater. These dimensions allow the waveguide connector 110 to advantageously fit between blades in a server rack, thereby not requiring reconfiguration or repositioning of blades within the rack.

Housing 120 may be made of a plurality of materials, such as metal, plastic, a composite, etc. Housing 120 may be of a conductive or nonconductive material. Housing 120 may be attached, affixed, secured, or otherwise operably coupled to waveguide bundle 130 and/or package 151. Housing 120 may partially or completely enclose each of the waveguides.

Each of the waveguides may be of any physical configuration, cross-section or geometry, such as straight, bent or curved. Each of the waveguides may be partially or fully contained within housing 120. Each of the waveguides may have a first end and a second end, connected by walls. The walls of the waveguides may be made of any of a plurality of conductive materials, such as metals, polymers, composites, etc. In another embodiment, housing 120 may be made of a material suitable for providing all or a portion of one or more walls of some or all of the waveguides, allowing the waveguides to be fabricated without creating individual walls (in such an embodiment, the walls of each of the waveguides would instead simply be provided in whole or in part by the housing 120 itself). Each of waveguides the may be hollow, partially filled with a dielectric material, or fully filled with a dielectric material such as plastic, porcelain, glass, gaseous nitrogen, etc. In another embodiment, the waveguides may be left partially or completely hollow, using air or a vacuum as a dielectric. The dimensions of the waveguides may be any of a plurality of geometric configurations. For example, the waveguides may have a transverse cross-sectional geometry that is about 1 mm×2 mm or greater, about 3 mm×3 mm or greater, about 2 mm×0.5 mm or greater, etc. The cross-sectional dimensions of the waveguide may also vary with the frequency of operation and the dielectric properties of the waveguide filling. For example, a waveguide using air as a dielectric filling operating at a frequency of about 100 GigaHertz (GHz) may have a transverse cross-sectional geometry that is about 1 mm×about 2 mm, while a waveguide using air as a dielectric filling operating at a frequency of about 200 GHz may have a transverse cross-sectional geometry that is about 0.62 mm×about 1.2 mm. The length of the waveguides may be, for example, about 5 mm or greater, about 10 mm or greater, about 15 mm or greater, about 25 mm or greater, about 100 mm or greater, etc. The waveguides may all be of a similar length, or may have different lengths. "Similar" lengths, as used herein may include waveguides whose lengths differ by, for example, about 0.1 mm or less, about 2 mm or less, about 5 mm or less, about 10 mm or less, or by about 1% or less, by about 3% or less, by about 5% or less, etc. The waveguides may have a transverse cross-sectional geometry that is constant along their length, or may have a variable cross-sectional geometry. Some or all of the waveguides may have a transverse cross-sectional geometry different from other waveguides, or they may all have the same or similar transverse cross-sectional geometry. The possible cross-sectional geometries of the waveguides will be described in further detail below.

The waveguides may be operably coupled to external waveguides. This may be accomplished in any of a number of ways. For example, one end of a waveguide may terminate with a waveguide transition feature. The waveguide transition feature may contain one or more features 114A, . . . 114N (collectively referred to as "waveguide transition feature"), as depicted in FIG. 1B. One end of an external waveguide may terminate in an external waveguide transition feature. The external waveguide transition feature may contain one or more features 134A . . . 134N (collectively referred to as "waveguide transition feature"). These transition features may be changes in the cross-sectional dimensions of either the waveguide or the external waveguide, and may be permanently attachable or detachably attachable to one another, allowing a waveguide to attach, be secured, or otherwise operably couple to a corresponding external waveguide.

In another embodiment, one of the waveguide transition feature or the external waveguide transition feature may be absent. If the waveguide transition feature is absent, then the external waveguide transition feature is capable of operably coupling to the waveguide itself. Similarly, if the external waveguide transition feature is absent, then the waveguide transition feature is capable of operably coupling to the corresponding external waveguide itself. In such an embodiment, waveguide transition feature may operably couple to the corresponding external waveguide using, for example, mechanical friction. In additional embodiments, transition features such as the waveguide transition feature and/or external waveguide transition feature may be capable of attaching to either a waveguide or another transition feature. The form of the transition features may vary and will be described in further detail below.

Similarly, waveguides may be operably coupleable to package outputs of package 151. One end of a waveguide may terminate in a package output attachment feature 116A, . . . , 116N (collectively referred to as "package output attachment feature"). In some embodiments, package output attachment feature is implemented as a transition feature, similar to the waveguide transition feature. Package output may attach directly to the waveguide without any package output attachment feature, as will be described in further detail below. Package output attachment feature(s) may be fabricated into package 151 during the manufacturing process of package 151, or may be attached afterwards.

In some embodiments, waveguides may remain on the same plane, as depicted in FIG. 1A. Each end of a waveguide (e.g., 112A) may be on the same plane as the corresponding end of the remaining waveguides (e.g., 112B, . . . , 112N). In other embodiments, some or all of waveguides may bend or curve in additional directions, which may result in some or all of waveguides being on different planes or even failing to be on any single plane. As a simple clarifying example, for any defined XYZ Cartesian coordinate system, if a waveguide is fabricated such that a first segment of the waveguide is parallel to the Y axis, a second segment that bends waveguide 90° to be parallel to the X axis, then after a straight third segment, a fourth segment that bends the waveguide another 90° to be parallel to the Z axis, then the waveguide will not fall within any single two-dimensional plane in the defined space XYZ.

A waveguide may be attached to both an external waveguide and a package output. This attachment may allow the signal from the package output to travel through, propagate through, or otherwise excite the waveguide and external waveguide. The package output may serve as an input, meaning this attachment may allow a signal from external waveguide to travel through, propagate through, or otherwise excite the waveguide and into the package input. Advantageously, the use of a waveguide may reduce or even eliminate signal degradation.

Waveguide connector 110 may be detachably attachable or permanently attachable to waveguide bundle 130, as will be described in further detail below. Waveguide connector 110 may also be detachably attachable or permanently attachable to package 151, as will be described in further detail below.

FIG. 1B illustrates a cross-section 100B of the waveguide connector 110 in FIG. 1A along sectional line B-B. Waveguides may be arranged along columns 140A, . . . , 140N (hereinafter referred to as "columns") or horizontal rows 150A, 150B, . . . , 150N (hereinafter referred to as "rows"). As seen in FIG. 1B, waveguide connector 110 may contain a plurality of vertically stacked rows of waveguides. For example, waveguide 112N, depicted in both FIG. 1A and FIG. 1B, may be above waveguide 112X, depicted in FIG. 1B. Waveguides in a column are horizontally offset from waveguides in a different column by a horizontal offset 146. Horizontal offset 146 may be, for example, about 10 μm or greater, about 50 μm or greater, about 0.5 mm or greater, about 1 mm or greater, about 1.5 mm or greater, about 2 mm or greater, about 5 mm or greater, about 10 mm or greater, etc. Waveguides in a row are vertically offset from waveguides of a different row by a vertical offset 152. Vertical offset 152 may be, for example, about 10 μm or greater, about 50 μm or greater, about 0.5 mm or greater, about 1 mm or greater, about 1.5 mm or greater, about 2 mm or greater, about 5 mm or greater, about 10 mm or greater, etc. In some embodiments, waveguides may actually contact other waveguides (e.g., horizontal offset 146 and/or vertical offset 152 may be zero). Waveguide connector 110 may only have a single row of waveguides 150A, . . . 150X. In another embodiment, waveguide connector 110 may only contain a single column of waveguides 112N, . . . , 112X. While FIG. 1B depicts waveguides arranged in a grid, rows may be also horizontally offset from other rows, as will be described in further detail below.

Figure 2:
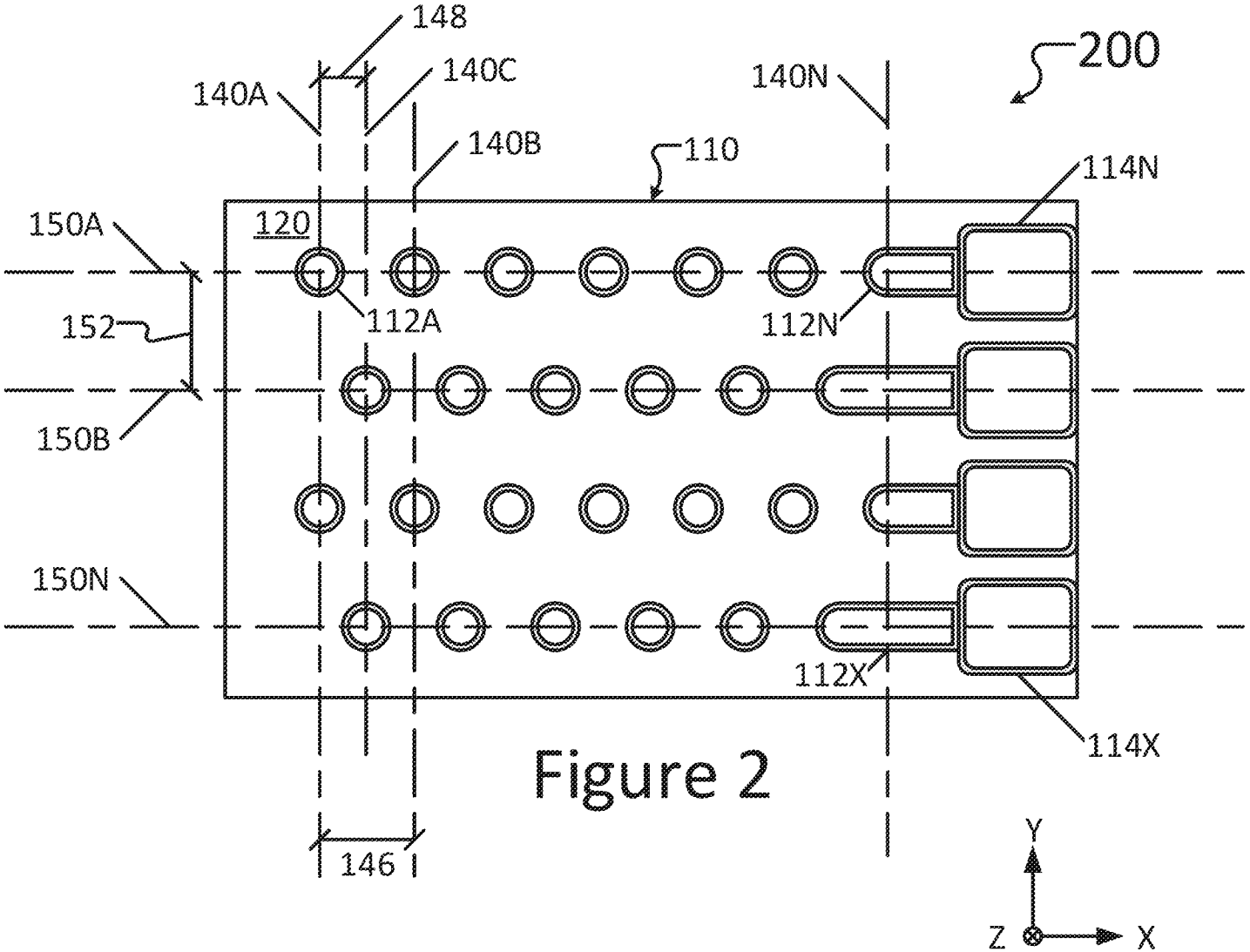
FIG. 2 illustrates a cross-section of the waveguide connector in FIG. 1A along sectional line B-B in accordance with another embodiment described herein.

FIG. 2 illustrates a cross-section 200 of the waveguide connector 110 in FIG. 1A along sectional line B-B in accordance with another embodiment described herein. In this embodiment some or all rows of the waveguides may be staggered or offset from other rows. For example, the waveguides of row 150B are not horizontally aligned with any waveguides of row 150A. The leftmost waveguides of rows 150B and 150N are instead aligned in column 140C, which is offset from column 140A by staggered offset 148. Staggered offset 148 may be, for example, about 0.25 mm or greater, about 0.5 mm or greater, about 1 mm or greater, about 1.5 mm or greater, about 2 mm or greater, about 5 mm or greater, about 10 mm or greater, etc. As depicted in FIG. 2, column 140C may also be offset from column 140B. Column 140C may be offset from column 140B by the same staggered offset 148 (placing column 140C directly between columns 140A and 140B), or column 140C may be offset from column 140B by a different amount. Some rows of the waveguides may align with other rows. Each of the waveguides 112N, . . . 112X may be connected to a waveguide transition feature 114N, . . . 114X or to a package output attachment feature (not shown in FIG. 2).

Figure 3:
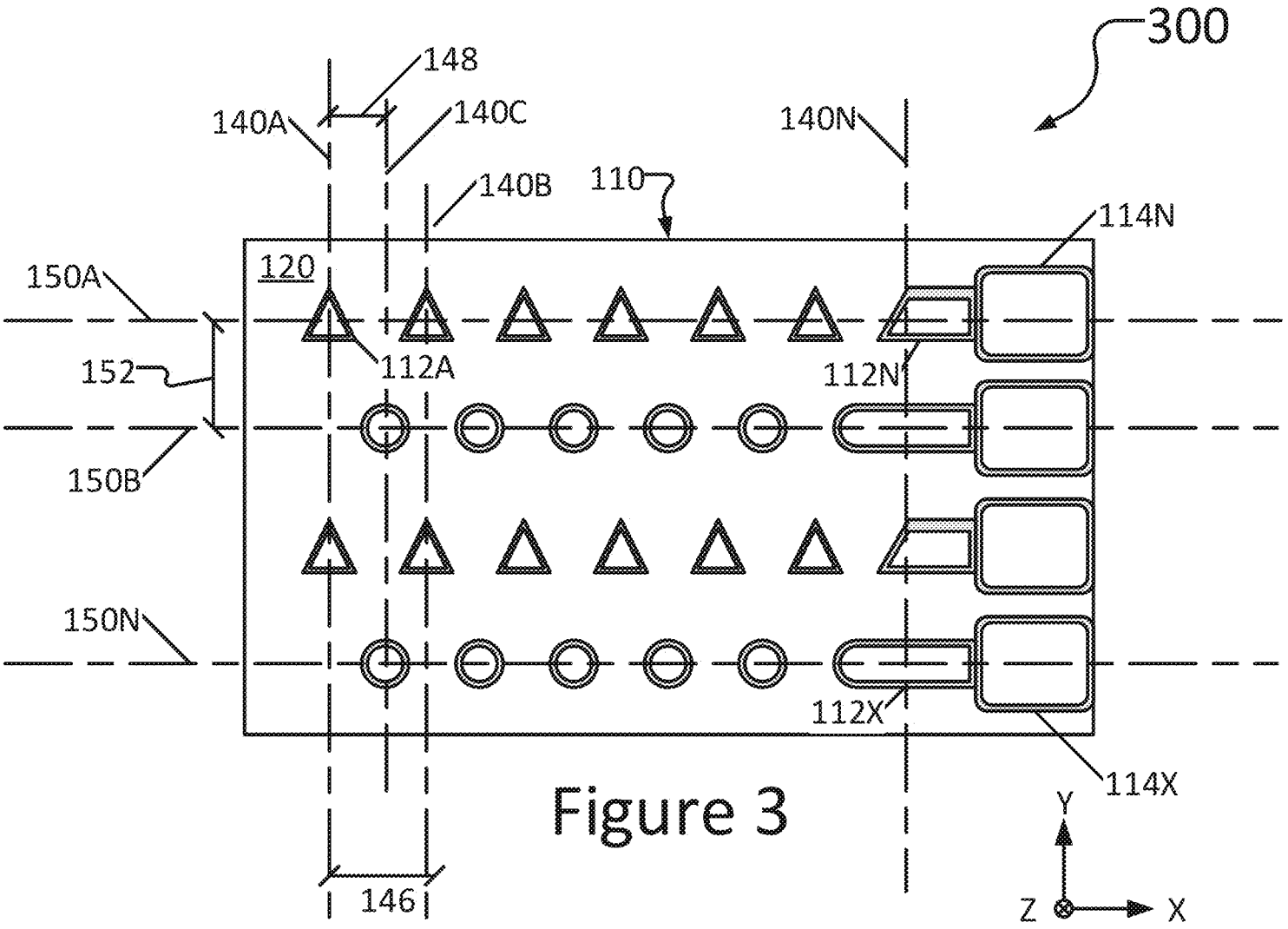
FIG. 3 illustrates a cross-section of the waveguide connector in FIG. 1A along sectional line B-B in accordance with another embodiment described herein.

FIG. 3 illustrates a cross-section 300 of the waveguide connector 110 in FIG. 1A along sectional line B-B in accordance with another embodiment described herein. As shown in FIG. 3, some of the waveguides may have different cross-sectional geometries than other waveguides. For example, waveguide 112A is depicted in FIG. 3 with a triangular cross-sectional geometry, while waveguide 112X has a circular cross-sectional geometry. Waveguides may also have different cross-sectional geometries from other waveguides contained within the same row. The cross-sectional geometry of each waveguide may be any polygonal shape. Dimensional notations of rows, columns, and offsets 152, 146, and 148 have been retained in FIG. 3 for simplicity.

Figure 4E:
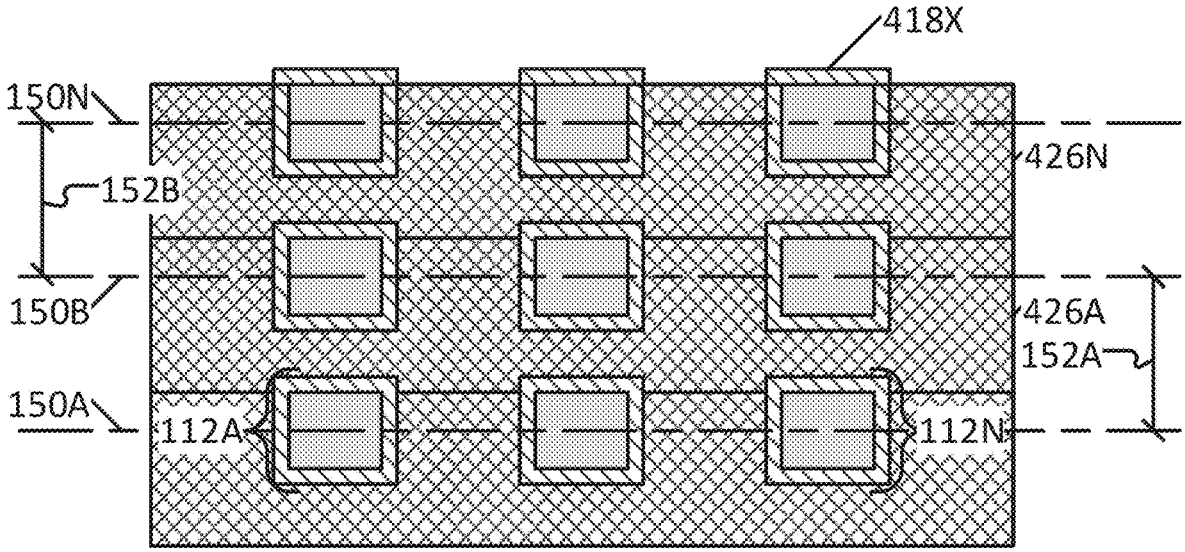
FIG. 4E illustrates a cross-section of the waveguide connector of FIGS. 4A-4D, including additional layers.

FIGS. 4A-4H illustrate cross-sections of an illustrative example of a waveguide connector in accordance with at least one embodiment described herein. FIG. 4A illustrates a base layer 410. Base layer 410 may be made of a non-conductive substrate such as a ceramic, a polymer, a plastic, or a dielectric composite material. Dielectric composite materials suitable for base layer 410 include glass-reinforced or paper-reinforced epoxy resins using dielectrics such as polytetrafluoroethylene, Flame Retardant-4 (FR-4), Flame Retardant-1 (FR-1), Composite Epoxy Material-1 (CEM-1), Composite Epoxy Material-3 (CEM-3), phenolic paper, or various other materials known to those skilled in the art. Base layer 410 may have any physical configuration or geometry. For example, base layer 410 may be about 30 mm or greater×about 4 mm or greater×about 30 mm or greater, or about 20 mm or greater×about 3 mm or greater× about 100 mm or greater, etc. Base layer 410 may be formed using any of a variety of methods. For example, base layer 410 may be formed using printing, 3D-printing, plating, photolithographic deposition, etc. Base layer 410 may have one or more grooves 414A, . . . , 414N (collectively referred to as "grooves"). Grooves may be evenly spaced from each other, or may be spaced inconsistently. Grooves may be any of a plurality of sizes. For example, grooves may be the same or larger than the waveguides. Grooves may be straight, curved, or bent. Grooves may be any polygonal shape. Grooves may be formed simply by fabricating base layer 410 "around" them (i.e., neglecting to fill in grooves), or may be formed subtractively (i.e., by removing material from base layer 410 to leave grooves).

FIG. 4B illustrates a cross-section of the waveguide connector of FIG. 4A, including added peripheral members 416A, . . . , 416N (collectively referred to as "peripheral members"). Peripheral members may be added to the inside of grooves. Peripheral members may be made of any one of a variety of conductive materials, including metals (copper, silver, gold, etc.) semiconductors, etc. Peripheral members may be fabricated by any one of a variety of methods, including plating, depositing, thermal oxidation, lamination, photolithographic deposition, electroplating, electroless plating, 3D printing, etc. Peripheral members may have any thickness. For example, peripheral members may be about 1 μm or greater, about 20 μm or greater, about 50 μm or greater, about 100 μm or greater, about 150 μm or greater, about 250 μm or greater, etc.

FIG. 4C illustrates a cross-section of the waveguide connector of FIGS. 4A and 4B, including added sacrificial material 422A, . . . , 422N (collectively referred to as "sacrificial material"). Metallized grooves 414A may be partially or completely filled with sacrificial material. The sacrificial material may be a dielectric material, metal, plastic, composite, etc. In some embodiments, the sacrificial material is a placeholder material and may be partially or completely removed later, as will be described below. In other embodiments, sacrificial material is not removed, and may function as a component of one or more of the waveguides.

FIG. 4D illustrates a cross-section of the waveguide connector of FIGS. 4A-4C, including added top members 418A, . . . , 418N (collectively referred to as "top members"). Top members may be added on top of sacrificial material and peripheral members Top members may be made of any one of a variety of conductive materials, including metals (copper, silver, gold, etc.) semiconductors, etc. Top members may be fabricated by any one of a variety of methods, including plating, depositing, thermal oxidation, lamination, photolithographic deposition, electroplating, electroless plating, 3D printing, etc. Top members may combine with peripheral members to partially or fully enclose sacrificial material. As top members are added, they may combine with peripheral members to form the walls of the waveguides. Top members may be similar in size or thickness to peripheral members (e.g., within +/−10 μm).

FIG. 4E illustrates a cross-section of the waveguide connector of FIGS. 4A-4D, including additional layers 426A, . . . , 426N (collectively referred to as "additional layers"). Additional layers may be added to base layer 410. Each of the additional layers may be formed in a manner similar to that depicted in FIGS. 4A-4D. Additional layers may partially or completely enclose the top members 418X of preceding layers. In another embodiment, no additional layers are added.

Figure 4F:
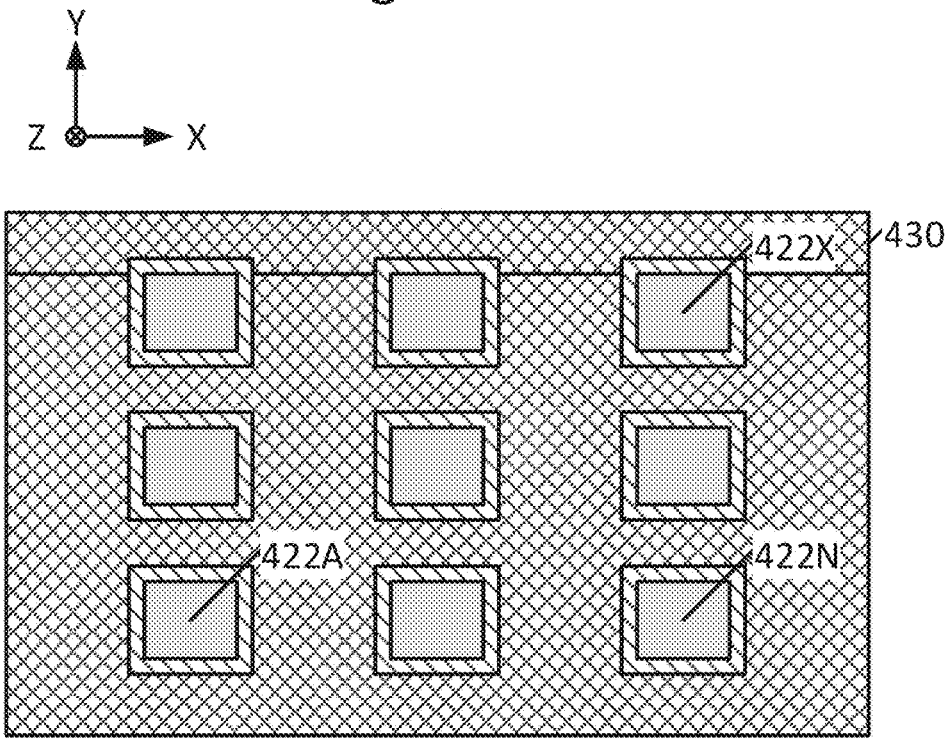
FIG. 4F illustrates a cross-section of the waveguide connector of FIGS. 4A-4E, including an added top layer.

FIG. 4F illustrates a cross-section of the waveguide connector of FIGS. 4A-4E, including an added top layer 430. Top layer 430 may be added to the uppermost (or topmost) layer of the waveguide connector. The topmost layer may be the last additional layer added, or if no additional layers have been added base layer 410 is also the topmost layer. Top layer 430 may partially or completely enclose top members 418 and/or waveguides of the topmost layer.

Figure 4G:
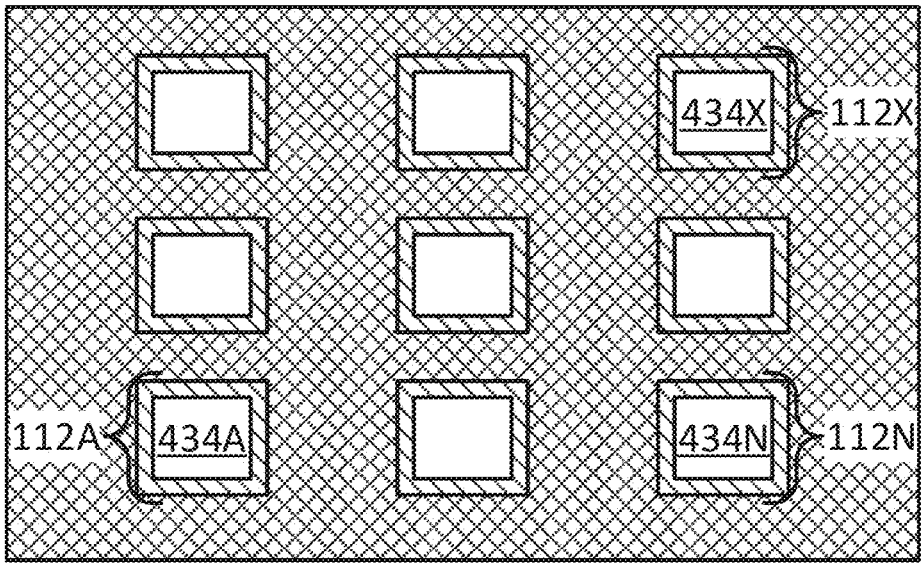
FIG. 4G illustrates a cross-section of the waveguide connector of FIGS. 4A-4F, with sacrificial material partially or completely removed, leaving behind cavities.

FIG. 4G illustrates a cross-section of the waveguide connector of FIGS. 4A-4F, with sacrificial material (i.e. 422A, 422N, . . . 422X) in FIG. 4F partially or completely removed, leaving behind cavities 434A, 434N, . . . , 434X (collectively referred to as "cavities"). The exact method of removal may depend on the specific makeup of sacrificial material. For example, if sacrificial material is made of a metal, removal may be accomplished chemically, mechanically, electrochemically, thermally, or combinations thereof. However, for example, if sacrificial material is a plastic, removal may preferentially be accomplished chemically, but may also be accomplished mechanically, electrochemically, thermally, or combinations thereof. Various other methods of removal may be feasible, as known by those skilled in the art.

In some embodiments, the waveguides may be left partially or completely hollow, and fabrication of the waveguides may be considered complete at the point depicted in FIG. 4G. In other embodiments, the waveguides may be filled with a material, as will be described in further detail below. In other embodiments, sacrificial material may be a dielectric material with an acceptable dielectric constant and loss tangent and is not removed. "Acceptable" dielectric constants may include, for example, dielectric constants of about 10 or less. The range of acceptable loss tangents may depend on the waveguide. For "internal" waveguides such as waveguides 112A, . . . , 112N, acceptable loss tangents include, for example, loss tangents about 0.1 or less. External waveguides may generally have stricter tolerances for loss tangents, e.g. may require a loss tangent of about 0.02 or less.

Figure 4H:
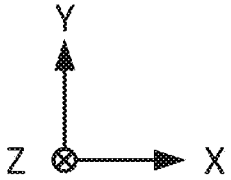
FIG. 4H illustrates a cross-section of the waveguide connector of FIGS. 4A-4G, with additional material added.
Figure 4H:
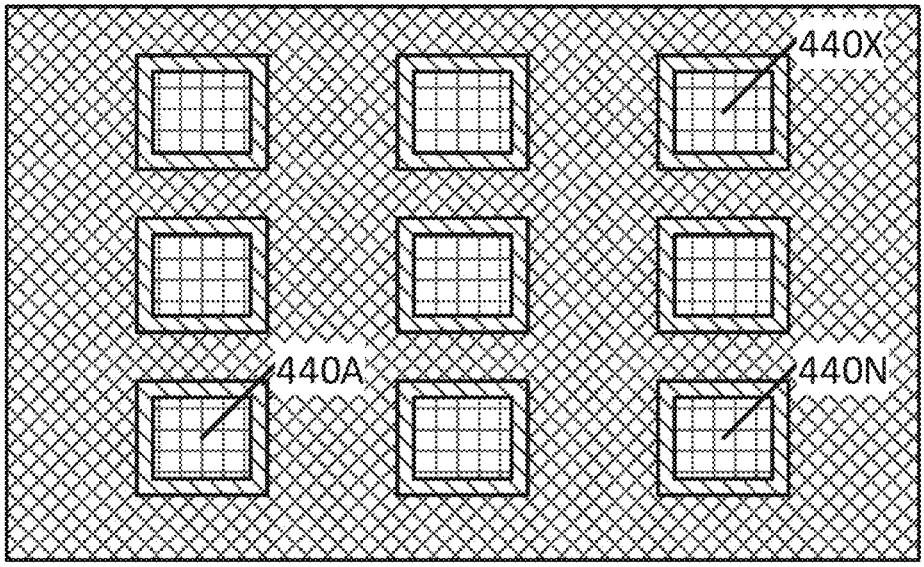

FIG. 4H illustrates a cross-section of the waveguide connector of FIGS. 4A-4G, with additional material 440A, 440N, . . . , 440X (collectively referred to as "additional material"). Additional material may be a dielectric such as a ceramic, a polymer, a plastic, or a dielectric composite material. The filling may be performed via depositing, plating, printing, etc.

Figure 5:
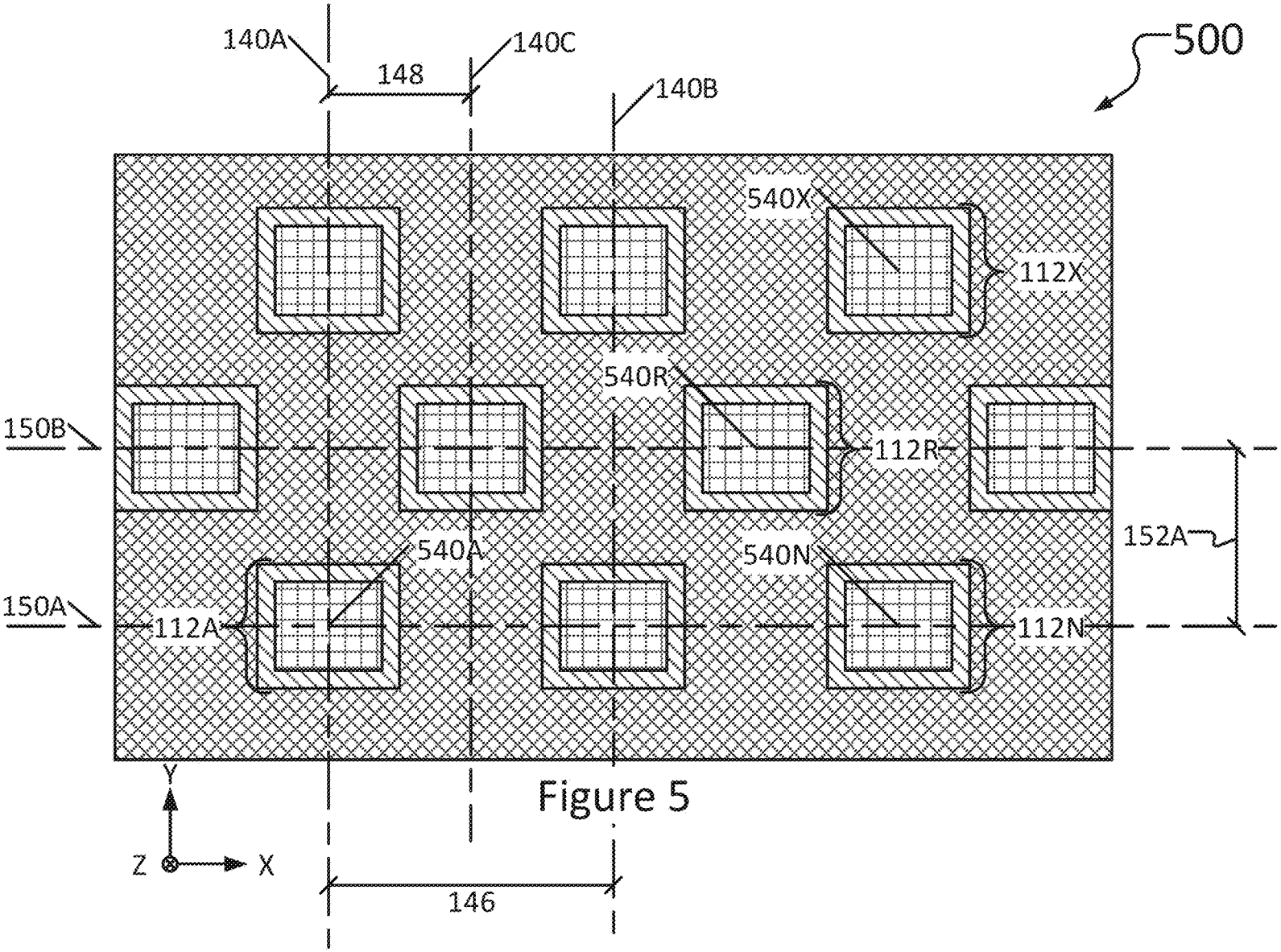
FIG. 5 illustrates a cross-section of an example waveguide connector in accordance with at least one other embodiment described herein.

FIG. 5 illustrates a cross-section 500 of an example waveguide connector in accordance with at least one other embodiment described herein. Instead of adding additional layers directly on top of each other or base layer 410, additional layers may be added in a "staggered" configuration, as seen in FIG. 5. Thus, rows of waveguides may be offset from one another. For example, waveguide 112N may be offset from waveguide 112X. In some embodiments, no waveguides may be vertically or horizontally aligned with any others. In other embodiments, some waveguides may be vertically aligned with others, as in a column. As depicted in FIG. 5, the waveguides may be filled with additional material 540A, 540N, 540R, . . . 540X, as described above (i.e. 440A, 440N, . . . , 440X in FIG. 4H). In some embodiments, the waveguides may be left partially or completely hollow.

Figure 6:
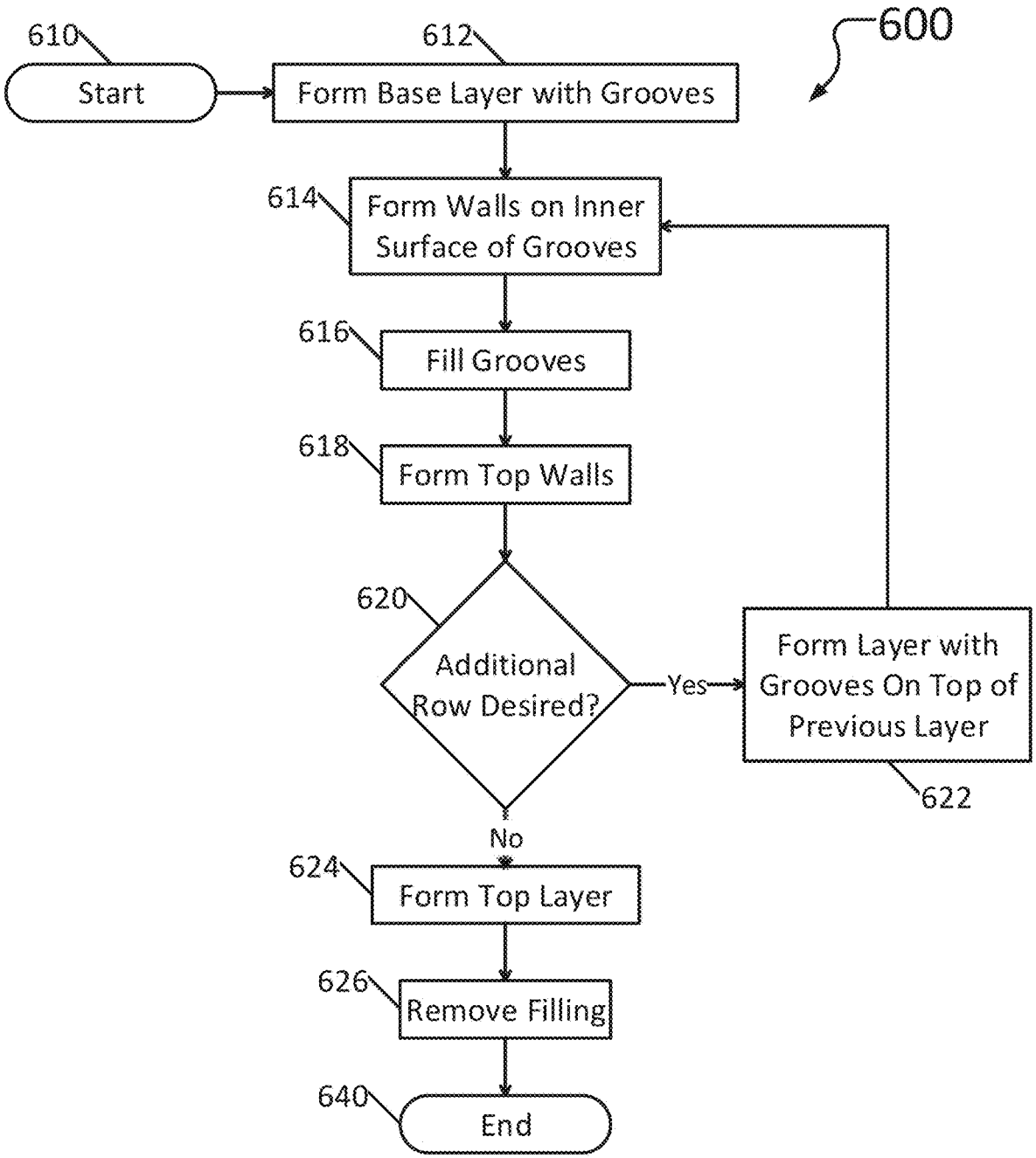
FIG. 6 is a high-level flow diagram of an illustrative method of fabricating a waveguide connector in accordance with one embodiment described herein.

FIG. 6 is a high-level flow diagram of an illustrative method 600 of fabricating a waveguide connector in accordance with one embodiment described herein. Generally, method 600 involves forming a base layer with grooves, preparing those grooves to function as waveguides, and optionally adding additional similar layers of waveguides. Method 600 may generally result in the various stages of fabrication of a waveguide connector depicted in FIGS. 4A-4H.

At step 610, a process of manufacturing a waveguide connector is initiated or started. At step 612, a base layer (such as base layer 410) is formed. Base layer 410 may be fabricated through a variety of means, including subtractive processes, additive processes, semi-additive processes, 3D printing, plating, etc. In this embodiment, step 612 further entails forming base layer 410 with a plurality of grooves (such as grooves). Grooves may be formed simply by fabricating base layer 410 "around" them (i.e., neglecting to fill in grooves), or may be formed subtractively (i.e., by removing material from base layer 410 to leave grooves).

At step 614, walls (such as peripheral members) are formed on the inner surfaces of grooves. As described above, peripheral members may be fabricated by any one of a variety of methods, including plating, depositing, thermal oxidation, lamination, photolithographic deposition, electroplating, electroless plating, etc.

At step 616, grooves are filled. Grooves may be filled with a sacrificial dielectric material (such as sacrificial material). The filling may be performed via depositing, plating, printing, etc.

At step 618, top walls (such as top members) are added on top of sacrificial material. Sacrificial material may be partially or completely enclosed at this point by peripheral members and top members. Top members may be formed in the same or a similar manner as peripheral members, or may be formed using a different one of the possible methods of forming peripheral members. For example, even if peripheral members are formed using photolithographic deposition, top members may be formed using 3D-printing.

At step 620, a determination is made of whether one or more additional rows (such as rows) of waveguides (such as the waveguides) are desired. If any additional rows are desired (i.e. Yes), then method 600 may further include repeating steps 614, 616, 618, 620, and 622 to form an additional layer at step 622 (such as additional layers), resulting in an additional row of waveguides. Note that the row of the waveguides of an additional layer may be offset from the previous row, as depicted in FIG. 5. If at step 620 no additional rows are desired (i.e. No), then at step 624, a top layer (such as top layer 430) may be formed above the uppermost layer (which may be base layer 410 or one of additional layers).

At step 626, the filling is removed. This filling may be sacrificial material. As discussed above, sacrificial material may be accomplished, for example, chemically, mechanically, electrochemically, thermally, or using combinations thereof. At step 640, the process is ended.

Figure 7:
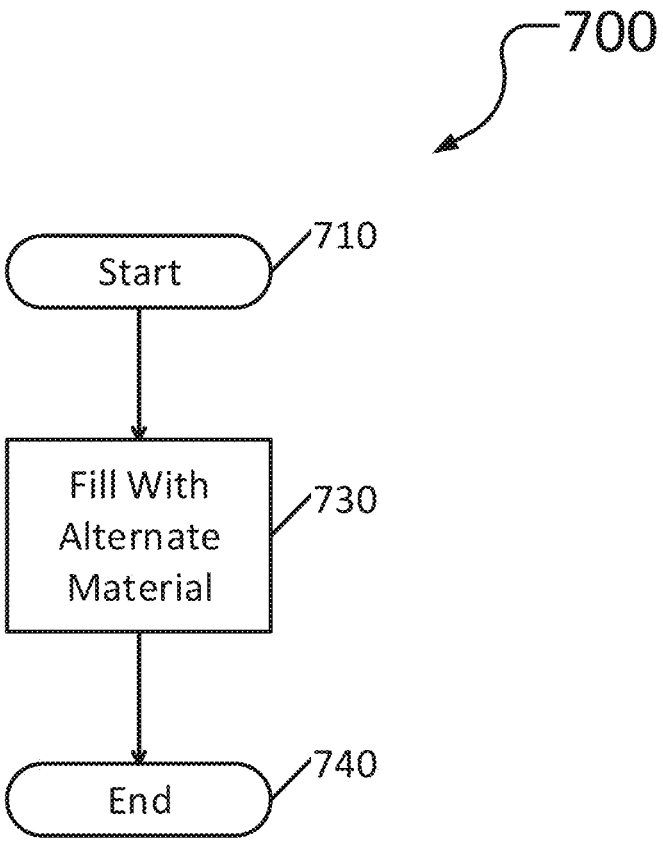
FIG. 7 is a high-level flow diagram of an illustrative method of partially or completely filling a waveguide with a dielectric material in accordance with one embodiment described herein.

FIG. 7 is a high-level flow diagram of an illustrative method 700 of partially or completely filling a waveguide (such as one of waveguides) with a dielectric material (such as additional material 440A, 440N, . . . , 440X). At step 710, a process of filling a waveguide is initiated or started. At step 730, cavities (such as cavities 434) are filled with another or alternate material, such as additional material 440A, 440N, . . . , 440X. This filling may be performed via depositing, plating, printing, etc. At step 740, the process is ended.

Figure 8A:
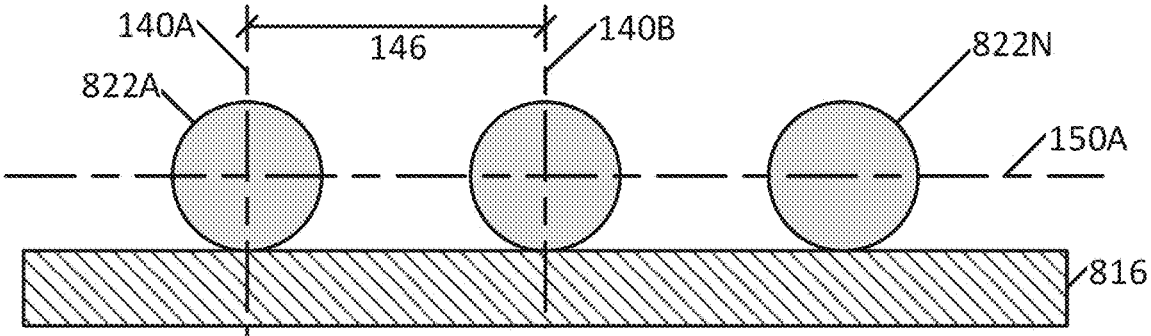
FIG. 8A illustrates a cross-section of an example waveguide connector in accordance with at least one embodiment described herein, including traces on a base layer.

FIGS. 8A-8G illustrate cross-sections of an example waveguide connector in accordance with at least one embodiment described herein. FIG. 8A illustrates a cross-section of an example waveguide connector in accordance with at least one embodiment described herein, including traces 822A, . . . , 822N (collectively referred to as "traces") on a base layer 816. Base layer 816 may be made of a metal, or any other conductive material. Base layer 816 may be fabricated via plating, depositing, 3D printing, etc. Base layer 816 may have any physical configuration or geometry. For example, base layer 816 may be about 30 mm or greater×about 4 mm or greater×about 30 mm or greater, or about 20 mm or greater×about 3 mm or greater×about 100 mm or greater, etc. Traces may be sacrificial members made of a sacrificial material, including the possible materials of sacrificial material (including a dielectric, a metal, a dielectric-coated metal, a plastic, a composite material, etc.), and may be removed later, as will be described in detail below. Traces may be straight, curved, or bent. Traces may be added to base layer 816 in any of a variety of ways, including printing, 3D-printing, depositing, attaching, plating, etc. Traces may have a cross-sectional geometry (as seen in FIG. 8A) of any polygonal shape. Traces may be of any size in any dimension, such as about 0.5 mm or greater×about 1 mm or greater, about 1 mm or greater×about 1 mm or greater, about 2 mm or greater×about 0.5 mm or greater, etc.

Figure 8B:
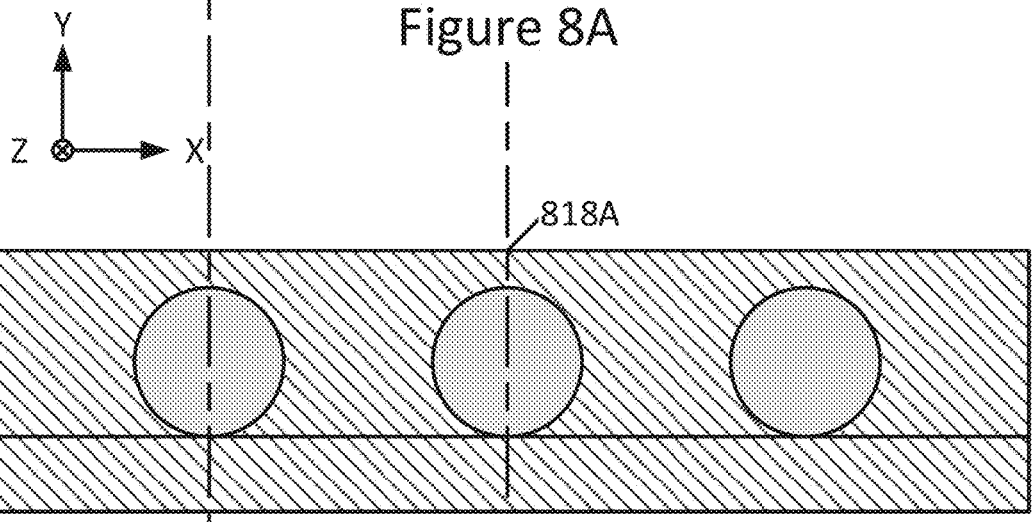
FIG. 8B illustrates a cross-section of the waveguide connector of FIG. 8A, including and added layer.

FIG. 8B illustrates a cross-section of the waveguide connector of FIG. 8A, including an added layer 818A. Layer 818A may be added on top of base layer 816, and may partially or completely enclose traces 822A, . . . , 822N.

Figure 8C:
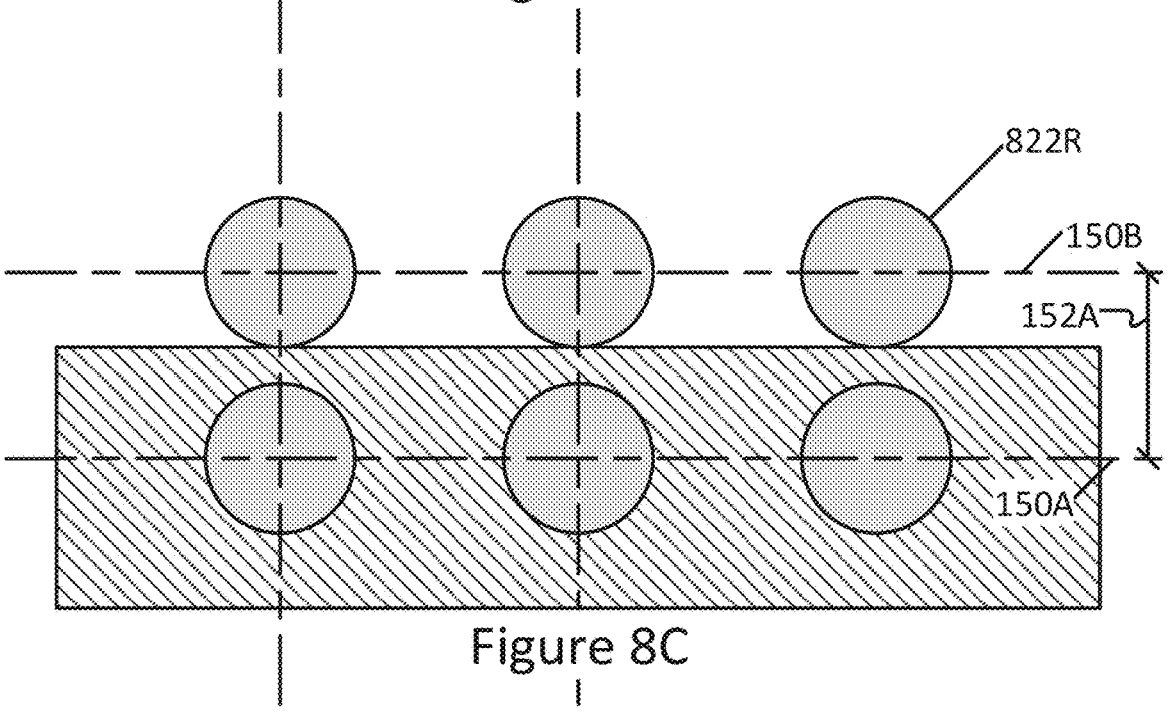
FIG. 8C illustrates a cross-section of the waveguide connector of FIGS. 8A and 8B, including additional traces.

FIG. 8C illustrates a cross-section of the waveguide connector of FIGS. 8A and 8B, including additional traces (including trace 822R). These additional traces may be added on top of layer 818A. The traces of the row including trace 822R may be aligned with the traces below them, such as along columns, or they may be offset or staggered, as will be discussed in further detail below. The traces added on top of layer 818A may be added using substantially the same method(s) described above. Traces may be aligned along rows, such as rows, and may be horizontally offset from each other by horizontal offset 146. If traces are staggered, they may be horizontally offset from traces of a different row by a different offset value, such as staggered offset 148 in FIG. 9, as will be described in further detail below.

Figure 8D:
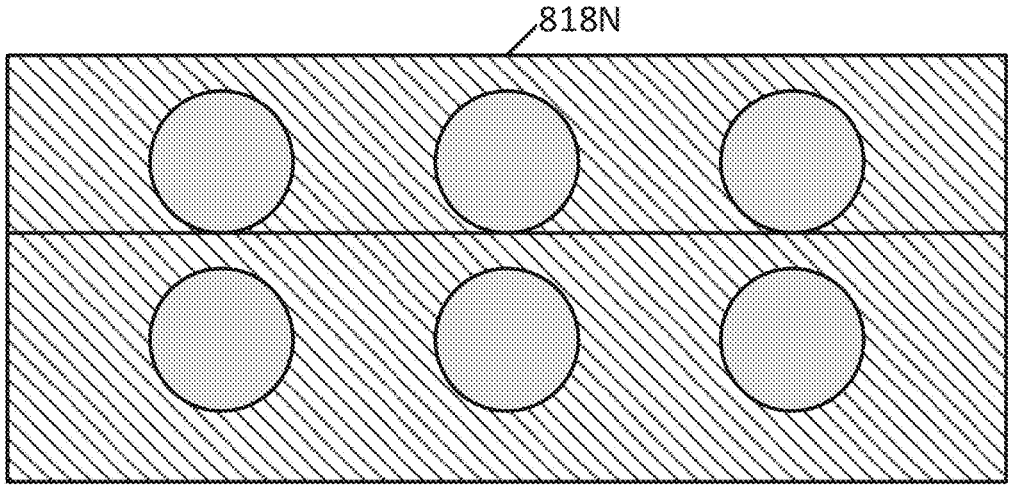
FIG. 8D illustrates a cross-section of the waveguide connector of FIGS. 8A-8C, including an additional layer.

FIG. 8D illustrates a cross-section of the waveguide connector of FIGS. 8A-8C, including an additional layer 818N. Layer 818N may partially or completely enclose trace 822R (not shown) and other traces on the same row. Layer 818N may be made of the same materials and may be formed in the same way as layer 818A.

Figure 8E:
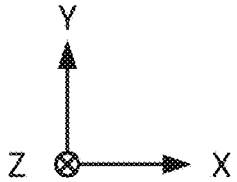
FIG. 8E illustrates a cross-section of the waveguide connector of FIGS. 8A-8D, including an additional layer.
Figure 8E:
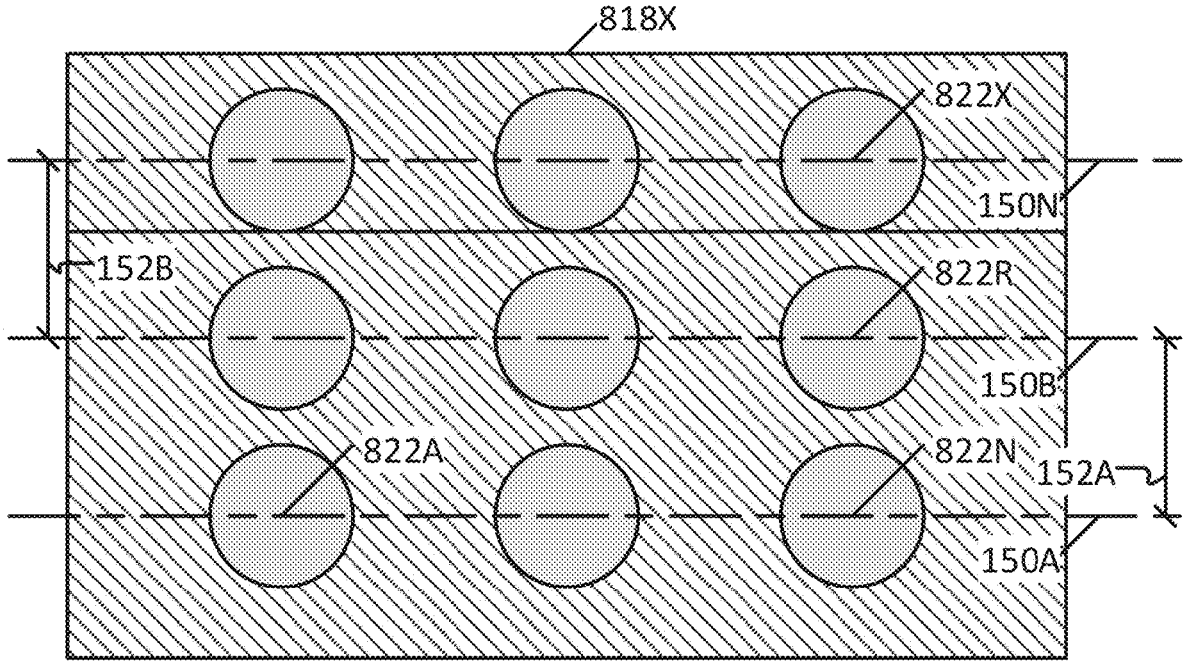

FIG. 8E illustrates a cross-section of the waveguide connector of FIGS. 8A-8D, including an additional layer 818X having additional traces 822X. Layer 818X which may be added using the operations depicted in FIGS. 8C and 8D. In another embodiment, no layers beyond 818A are added. In another embodiment, traces are made of a dielectric material suitable for waveguides, and are therefore not removed.

Figure 8F:
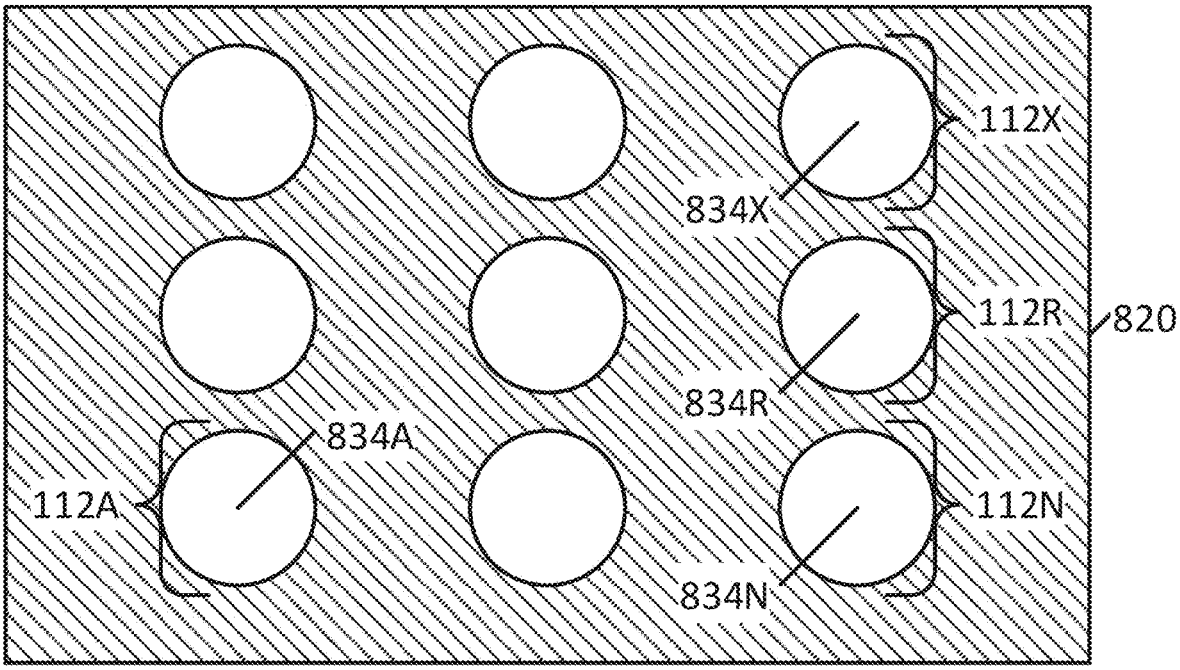
FIG. 8F illustrates a cross-section of the waveguide connector of FIGS. 8A-8E, with traces partially or completely removed, leaving behind cavities.

FIG. 8F illustrates a cross-section of the waveguide connector of FIGS. 8A-8E, with traces partially or completely removed, leaving behind cavities 834A, 834N, 834R, and 834X (collectively referred to as "cavities"). The exact method of removal may depend on the specific makeup of traces. For example, if traces are made of a metal, removal may be accomplished chemically, mechanically, electrochemically, thermally, or using combinations thereof. As a different example, if traces are a plastic, removal may be accomplished preferably chemically, but may still be accomplished mechanically, electrochemically, thermally, or using combinations thereof. Various other methods of removal may be feasible, as known by those skilled in the art. In some embodiments, the waveguides may be left partially or completely hollow, as in FIG. 8F. In other embodiments, the waveguides may be filled with another material. In still other embodiments, traces may be a dielectric material and are not removed.

Figure 8G:
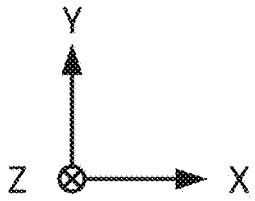
FIG. 8G illustrates a cross-section of the waveguide connector of FIGS. 8A-8F, with additional material added.
Figure 8G:
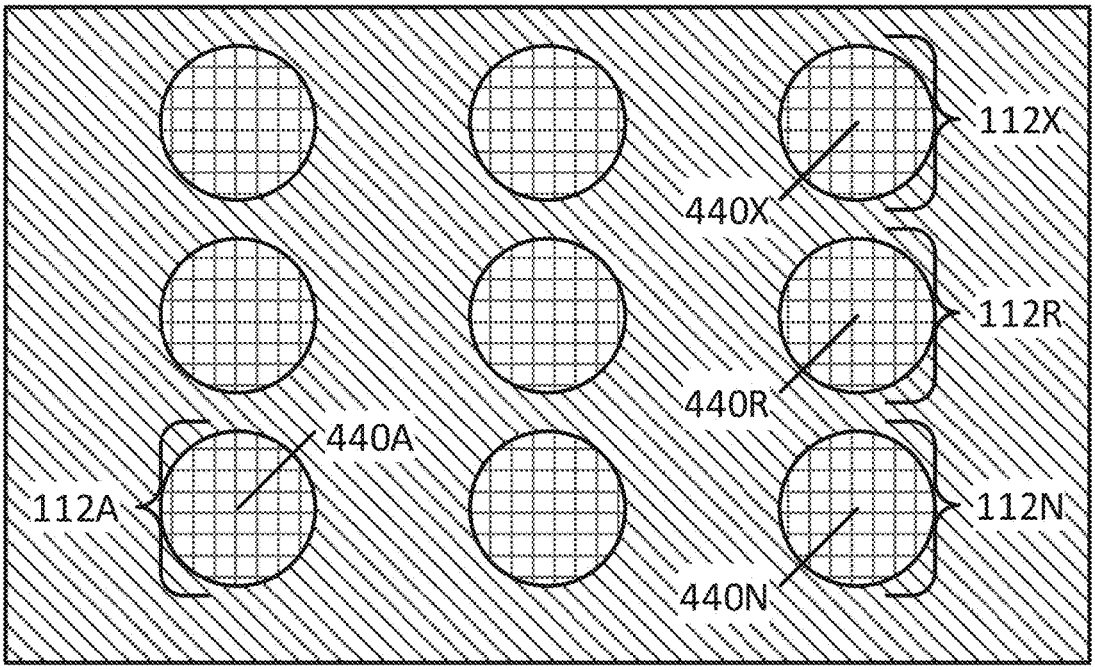

FIG. 8G illustrates a cross-section of the waveguide connector of FIGS. 8A-8F, with additional material 440A, 440N, 440R, . . . 440X added. As described above, additional material may be partially or completely filled into the waveguides 112A, 112N, 112R, . . . 112X via a plurality of methods. For example, the waveguides may be partially or completely filled with additional material via depositing, plating, printing, etc. as shown in FIG. 4H.

Figure 9:
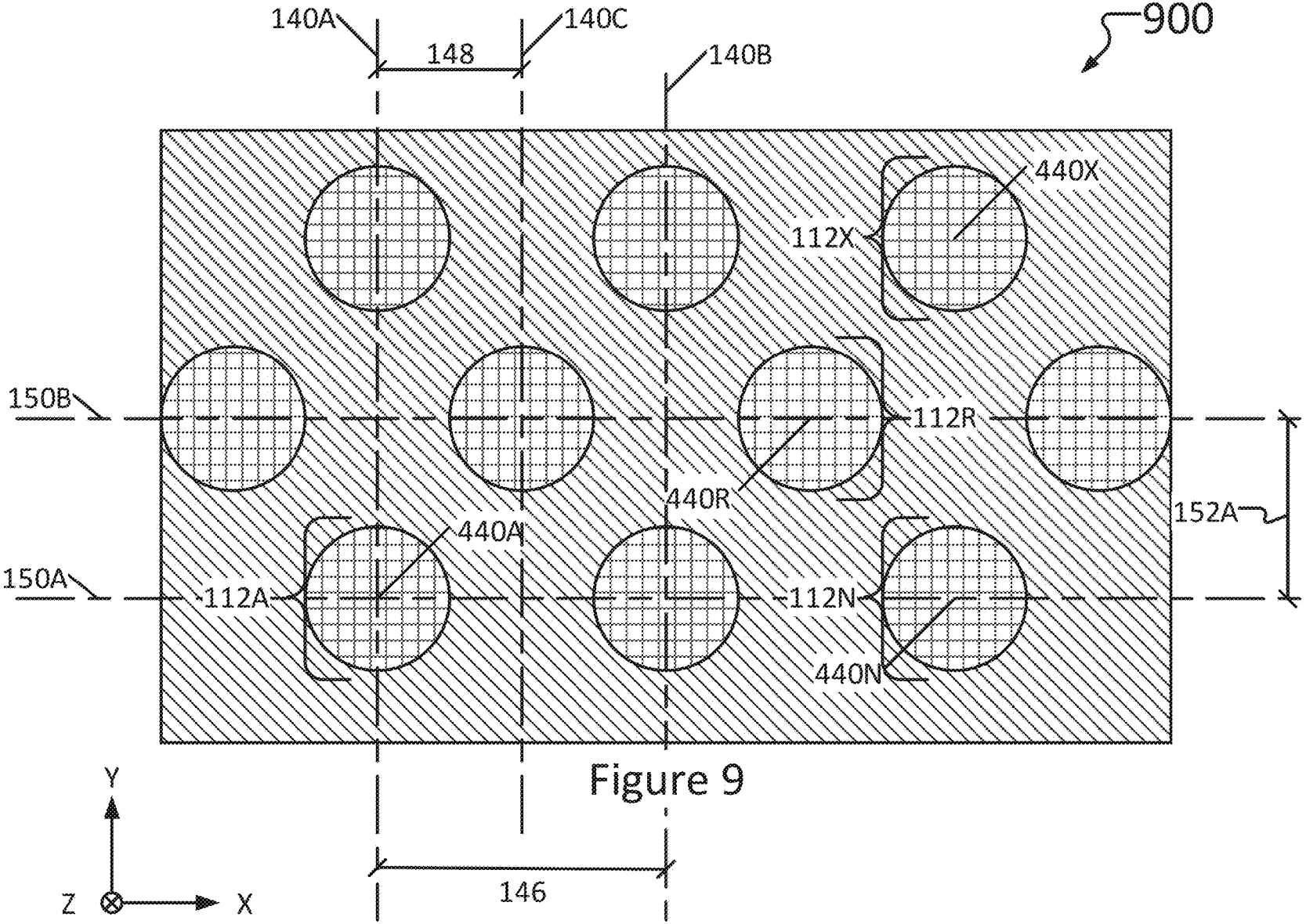
FIG. 9 illustrates a cross-section of an example waveguide connector in accordance with another embodiment described herein.

FIG. 9 illustrates a cross-section 900 of an example waveguide connector in accordance with another embodiment described herein. Instead of adding additional layers 818N, . . . , 818X so that the waveguides are directly on top of each other or the waveguides of layer 818A as in FIGS. 8A-8G, additional layers may be added in a "staggered" configuration, as seen in FIG. 9. Thus, rows 150A and 150B of the waveguides may be added such that columns 140A, 140B and 140C of the waveguides are horizontally offset from one another. For example, waveguide 112R may be offset from waveguides 112N and 112X. In some embodiments, no waveguides may be vertically or horizontally aligned with any others. In other embodiments, some waveguides may be vertically aligned with others. As depicted in FIG. 9, the waveguides may be partially or completely filled with additional material 440A, 440N, 440R, . . . 440X, as discussed above. The waveguides may be left partially or completely hollow.

Figure 10:
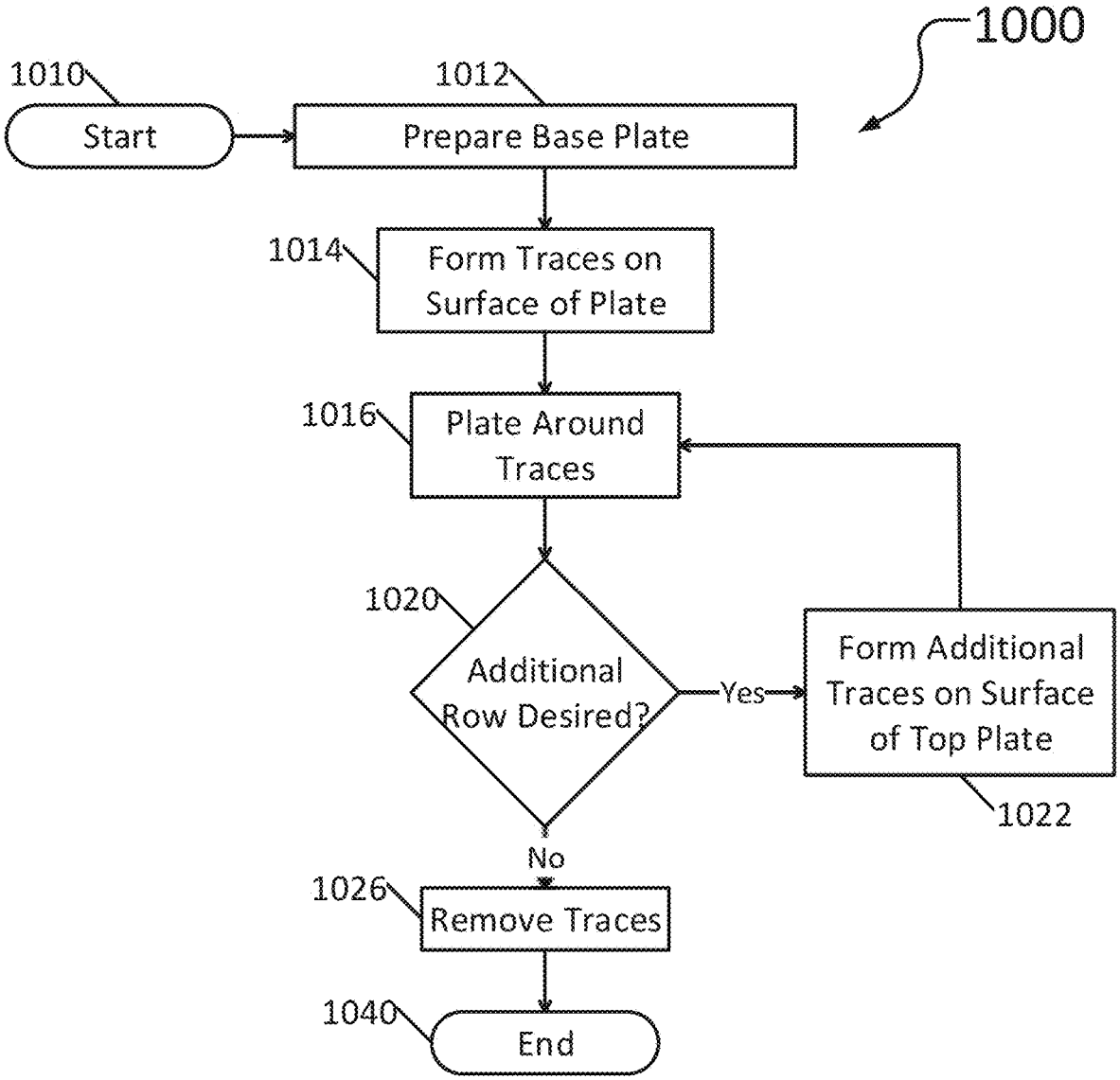
FIG. 10 is a high-level flow diagram of an illustrative method of fabricating a waveguide connector in accordance with one embodiment described herein.

FIG. 10 is a high-level flow diagram of an illustrative method 1000 of fabricating a waveguide connector in accordance with one embodiment described herein. Generally, method 1000 involves preparing a base plate with formed traces, adding any desired additional layers of plate and traces, and removing the traces. Method 1000 may generally result in the various stages of fabrication of a waveguide connector depicted in FIGS. 8A-8G.

At step 1010, a process of manufacturing a waveguide connector is initiated or started. At step 1012, a base plate (such as base layer 816, not shown) is formed. Base layer 816 (not shown) may be fabricated through a variety of means, including subtractive processes, additive processes, semi-additive processes, 3D printing, plating, etc. as shown in FIG. 8A.

At step 1014, traces (such as traces 822A, . . . , 822N) are formed on the surface of the plate. As discussed above, traces may be added to base layer 816 (not shown) in any of a variety of ways, including printing, 3D-printing, depositing, attaching, plating, etc. as shown in FIG. 8A. At step 1016, additional plating (such as layer 818A) is formed around traces. Additional layer 818A may be added in any of the ways base layer 816 (not shown) is made, including subtractive processes, additive processes, semi-additive processes, 3D printing, plating, etc. as shown in FIG. 8B.

At step 1020, a determination is made of whether or not to add additional rows (such as rows of the waveguides). If additional rows are desired (i.e. Yes), further operations may include forming additional traces at step 1022 (i.e. 822A, . . . , 822N, not shown) on the surface of the uppermost plate (such as layer 818A, not shown, or the most recently added additional layer) and proceeding to step 1016. If no additional rows are desired (i.e. No) at step 1020, at step 1026 traces are removed. At step 1040, the process is ended as shown in FIGS. 8C-8G.

Figure 11:
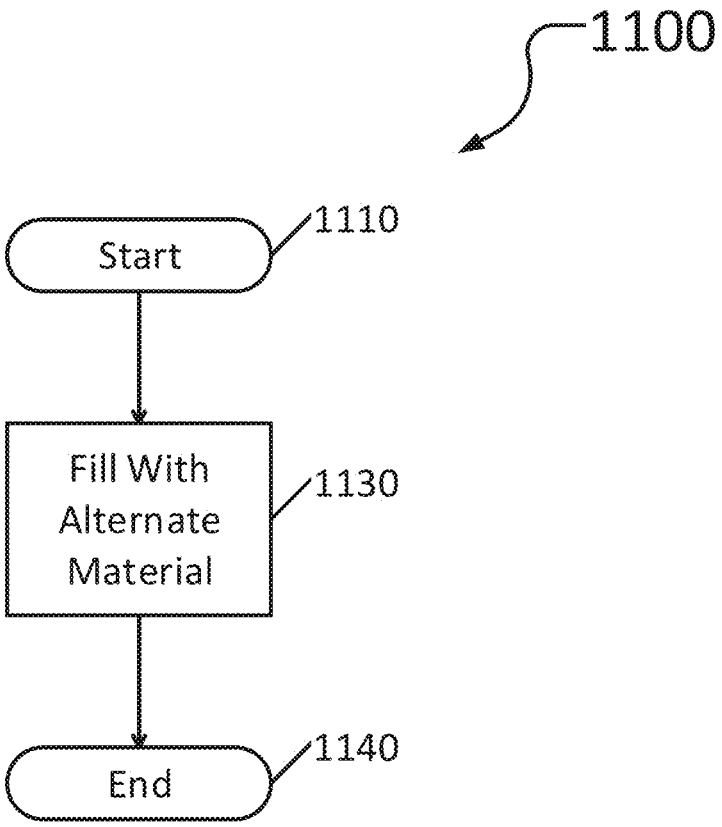
FIG. 11 is a high-level flow diagram of an illustrative method of partially or completely filling a waveguide with a dielectric material in accordance with one embodiment described herein.

FIG. 11 is a high-level flow diagram of an illustrative method 1100 of partially or completely filling a waveguide (such as one of the waveguides as shown in FIG. 1A) with a dielectric material (such as additional material 440A, 440N, . . . , 440X as shown in FIG. 4H). At step 1110, a process of filling a waveguide is initiated or started. At step 1130, cavities (such as cavities 834A, 834N, 834R, and 834X as shown in FIG. 8F) are filled with another or alternate material, such as additional material 440A, 440N, . . . , 440X. This filling may be performed via depositing, plating, printing, etc. At step 1140, the process is ended.

Figure 12:
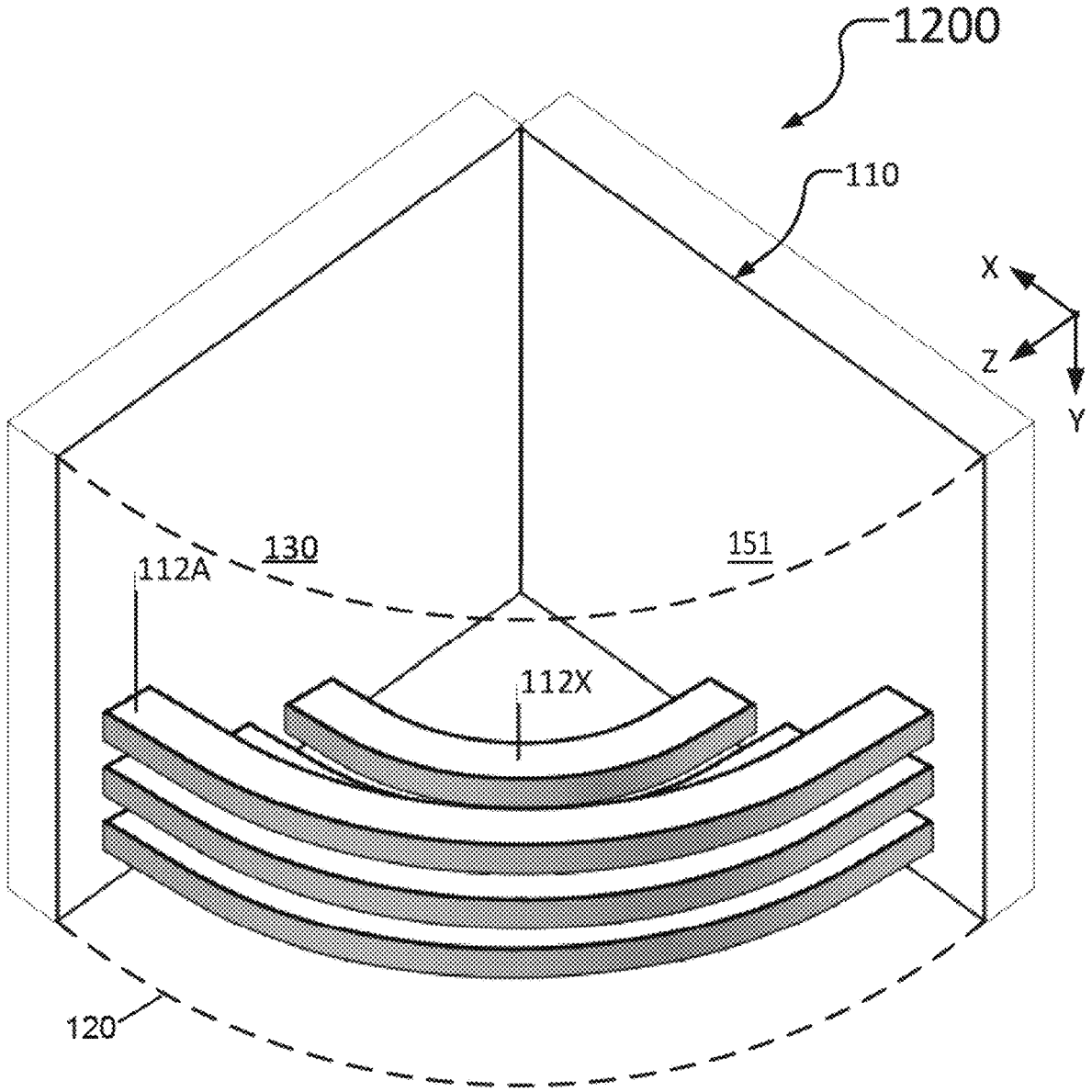
FIG. 12 illustrates a three-dimensional cutaway view of an example waveguide connector in accordance with at least one embodiment described herein.

FIG. 12 illustrates a three-dimensional cutaway view 1200 of an example waveguide connector 110 in accordance with at least one embodiment described herein. Waveguides 112A, . . . 112X may be operably coupled to waveguide bundle 130 and/or may be operably coupled to package 151. Note that none of the waveguides depicted in FIG. 12 move in the positive or negative Y direction. This means that in this embodiment, multiple waveguides on the same X-Z plane may not have the same or similar length.

FIG. 12 depicts five waveguides for ease of understanding. Other embodiments may have more or fewer waveguides. Further, as mentioned above, the waveguides may be partially or fully contained within housing 120, which has been cut away in FIG. 12 for simplicity. The boundaries of housing 120 are represented in FIG. 8 by dashed lines. While housing 120 is depicted as a "pie shape" in FIG. 12, housing 120 may be any of a plurality of shapes, including a cube, a partial sphere, or any other polygonal shape. The waveguides may be curved, allowing a signal to propagate from package 151 to waveguide bundle 130 (or from waveguide bundle 130 to package 151) without bending either package 151 or waveguide bundle 130. The waveguides may be partially or completely hollow or partially or completely filled with a material. The waveguides may have waveguide transition features as shown in FIG. 1 A, which are not shown for simplicity. The dimensions of package 151 may vary. For example, package may be about 20 mm or greater× about 20 mm or greater×about 0.5 mm or greater. The dimensions of waveguide bundle 130 may also vary. For example, waveguide bundle 130 may be about 2 meters (m) or greater×about 10 mm or greater×about 10 mm or greater. A 10 mm×10 mm waveguide connector 110 may contain, for example, 16 waveguides in a 4×4 array.

Figure 13:
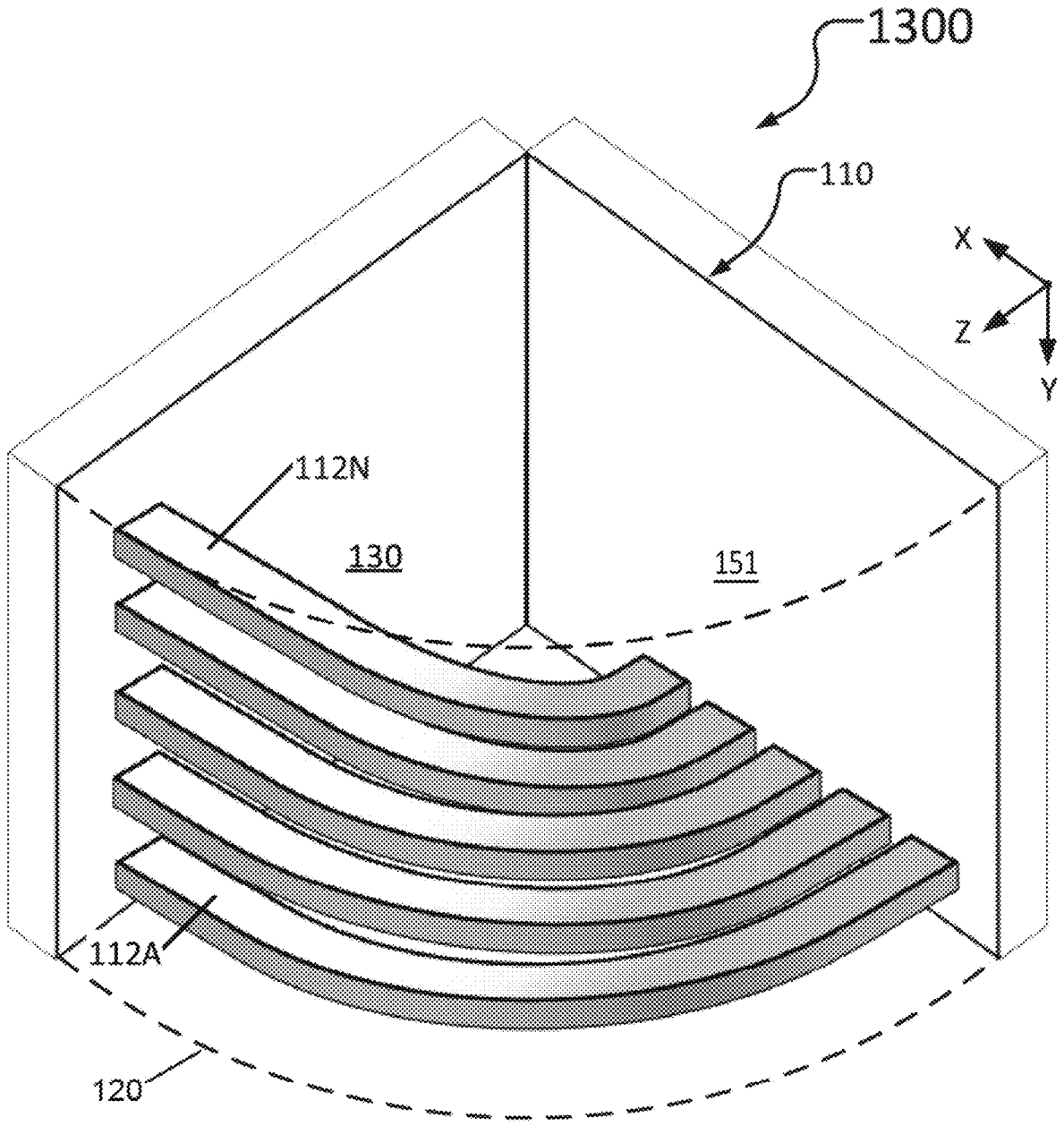
FIG. 13 illustrates a three-dimensional cutaway view of another example waveguide connector in accordance with at least one embodiment described herein.

FIG. 13 illustrates a three-dimensional cutaway view 1300 of another example waveguide connector 110 in accordance with at least one embodiment described herein. Waveguides 112A, . . . , 112N may be bent in more than one dimension. The waveguides may be of equal length.

For example, waveguide 112A remains on the X-Z plane, but extends from the farthest corner (i.e., in the negative X direction) of package 151 to the farthest corner (i.e., in the positive Z direction) of waveguide bundle 130 as shown in FIG. 13. However, in this embodiment, waveguide 112N extends from the closest corner (i.e., in the positive X direction) of the package. In some embodiments, such as that depicted in FIG. 12, all of the waveguides connect to a point on the same X-Z plane as they originate, and therefore waveguide 112N would have to connect to the closest corner (i.e., in the negative Z direction) of waveguide bundle 130 (for example, see waveguide 112X as depicted in FIG. 12). However, such a waveguide would be substantially shorter than, for example, waveguide 112A (as depicted in either FIG. 12 or FIG. 13). As signals carried or transported through waveguides may degrade depending on the length of a waveguide, it is advantageous to have all waveguides remain the same or similar length.

Thus, in the embodiment depicted in FIG. 13, waveguide 112N extends from the closest corner of the package 151 to the farthest corner (i.e., in the positive Z direction AND the negative Y direction) of the waveguide bundle 130. Extending in the Y direction as well advantageously allows waveguide 112N to have a length that is the same or similar to waveguide 112A (e.g., within ±50 μm).

As depicted in FIG. 13, the waveguides may each have one end in a horizontal alignment, but bend such that the other end of each of the waveguides is in a vertical alignment. This may allow waveguides to propagate a signal between waveguide bundle 130 and package 151 without bending waveguide bundle 130 or package 151, and while advantageously keeping waveguides at a constant or similar length. Keeping waveguides at a constant or similar length is desirable because it may promote signal cohesion and alleviate dispersion. Because the length of a waveguide may impact the transmitted signal (e.g. impact their phase component), a waveguide connector such as one consistent with the present disclosure may be more effective or desirable if it keeps all of the waveguides at a constant or similar length. In other embodiments, waveguides may be in other "transplanar" arrangements allowing waveguides to be of a constant or similar length while bending.

Note that like FIG. 12, FIG. 13 also depicts five waveguides for ease of understanding. Other embodiments may have more or fewer waveguides. Further, the waveguides may be partially or fully contained within housing 120, which has been cut away in FIG. 13 for clarity. The boundaries of housing 120 are represented in FIG. 13 by dashed lines.

Figure 14:
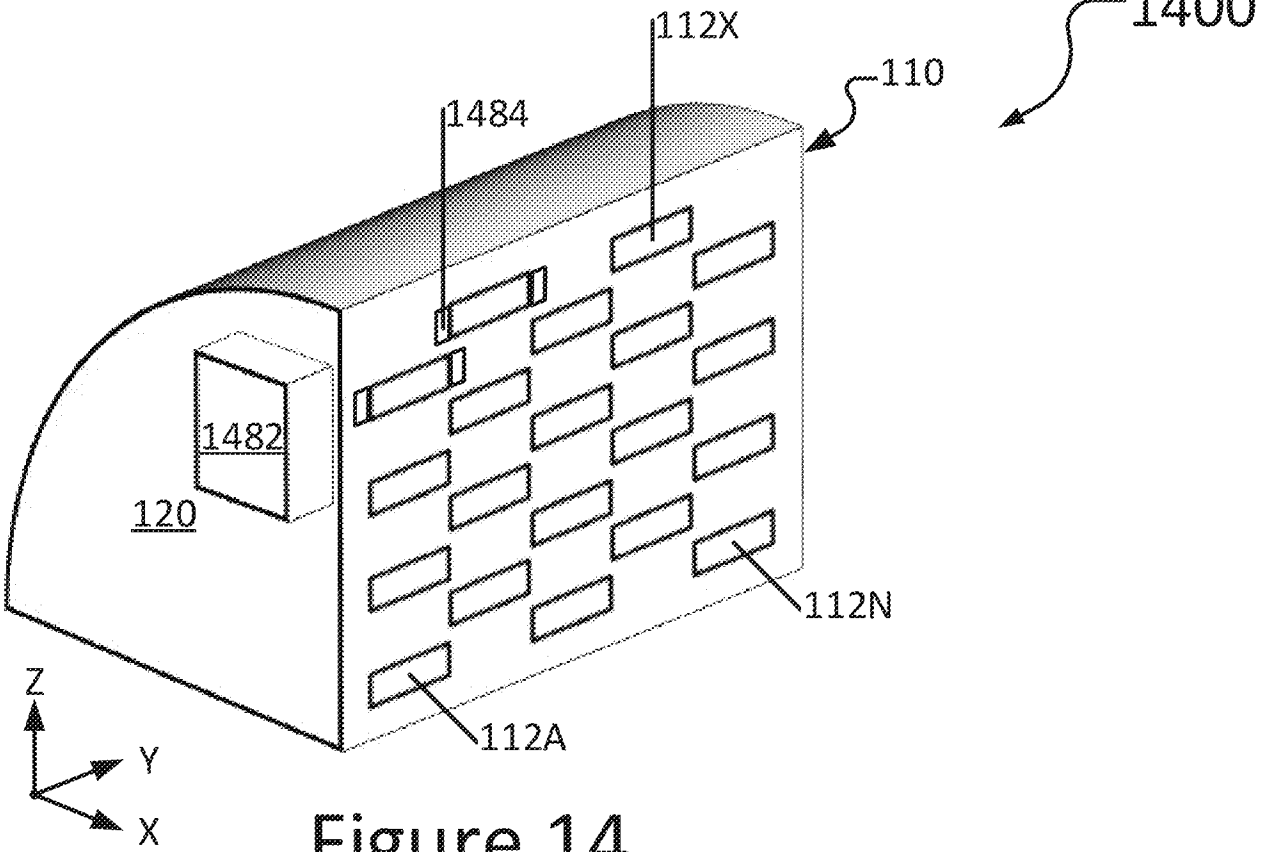
FIG. 14 illustrates a general three-dimensional cutaway view of another example waveguide connector in accordance with at least one embodiment described herein.

FIG. 14 illustrates a general three-dimensional cutaway view 1400 of another example waveguide connector 110 in accordance with at least one embodiment described herein. In this embodiment, connector 110 comprises housing 120 and waveguides 112A, . . . 112N. Only the first end of the waveguides is depicted in FIG. 14; the second end of the waveguides may be along the bottom face (where the bottom face is parallel to the X-Y plane at minimum Z) of housing 120. Note that in FIG. 14, the waveguides are depicted in a staggered layout, which is mentioned above as one possible embodiment. The waveguide may be in a grid layout, or any other feasible layout (e.g., arranged along a single line, in a circle, in a plurality of concentric circles, in a "cross" or X layout, etc.). The waveguides are also depicted as having a rectangular cross-sectional geometry, but as discussed above (e.g., FIG. 3), the waveguides may have any of a plurality of cross-sectional geometries. As discussed above (e.g., FIG. 12), housing 120 is depicted as having a "pie-slice" shape, but may have any of a plurality of shapes. A waveguide connector 110 may have one or more housing attachment features 1482, as depicted in FIG. 14. Housing attachment features 1482 may allow the waveguide connector 110 to attach, secure, or otherwise operable couple to either a waveguide bundle 130 (not shown) or a package 151 (not shown). Housing attachment features 1482 may be any of a variety of forms and utilize any of a variety of means to secure waveguide connector 110 to waveguide bundle 130 or package 151. For example, housing attachment features 1482 may utilize mechanical features (e.g., screws, bolts, ratchets, binding, snaps, etc.), chemical features (e.g., adhesives, bonding agents, etc.) thermal features (e.g., soldering, welding, etc.), or electromagnetic features (e.g., magnets, electrical fields, etc.). FIG. 14 also depicts waveguide attachment features 1484 alongside some of the waveguides. Note that not all waveguides are depicted in FIG. 14 as having waveguide attachment features 1484 for simplicity. In other embodiments, none, some, or all of the waveguides may have waveguide attachment features 1484. Waveguide attachment features 1484 allow the waveguides to be secured, attached, connected, or otherwise operably coupled to external waveguides (not shown) or package outputs (not shown). Waveguide attachment features 1484 may utilize any of the means described for housing attachment features 1482, such as mechanical features, chemical features, thermal features, or electromagnetic features. Waveguide attachment features 1484 are depicted in FIG. 14 as being external to housing 120. However, in other embodiments, waveguide attachment features 1484 may be partially or fully contained within housing 120.

Figure 15:
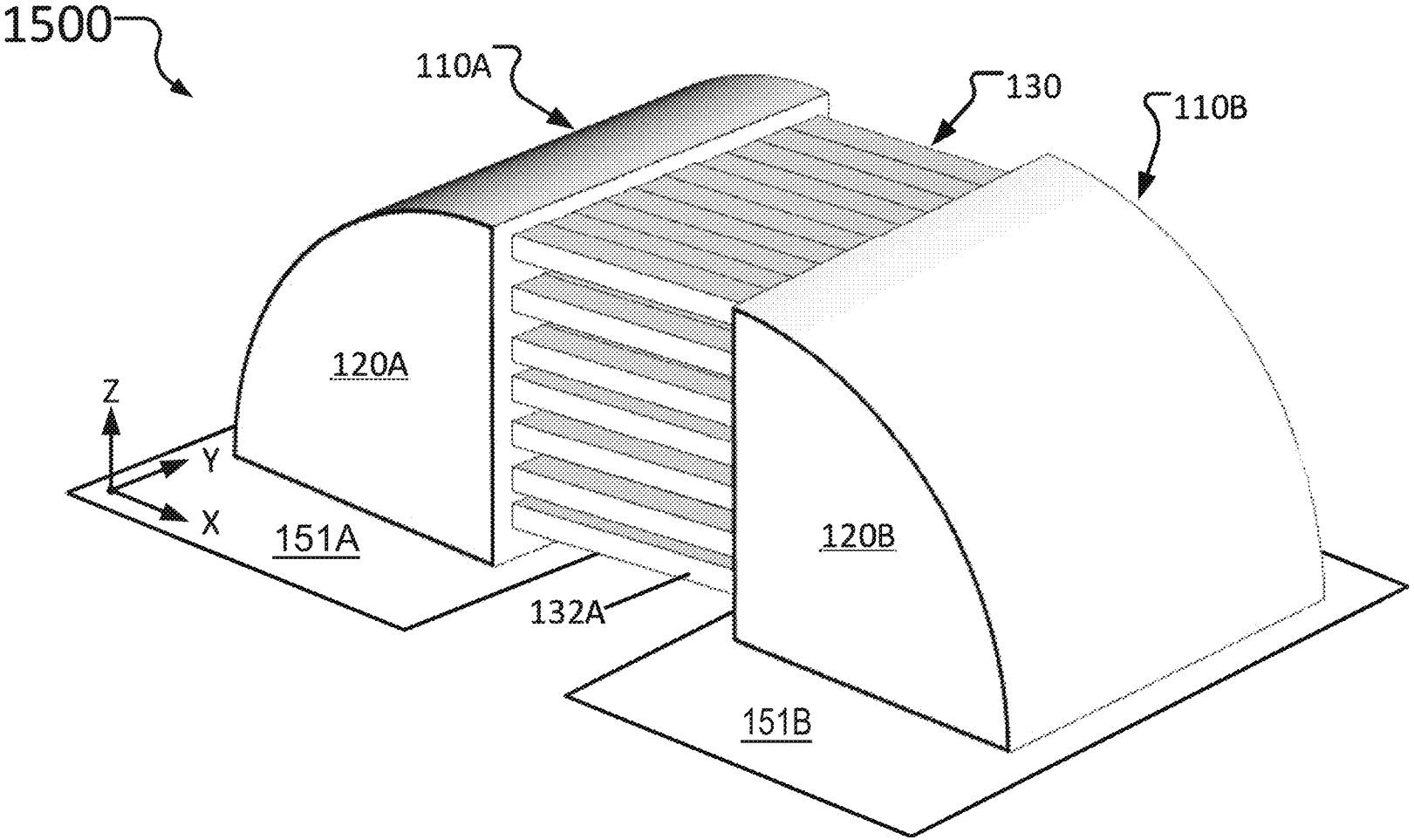
FIG. 15 illustrates a general three-dimensional view of a waveguide connector system in accordance with at least one embodiment described herein.

FIG. 15 illustrates a general three-dimensional view (i.e. X-Y-Z directions) 1500 of a waveguide connector system in accordance with at least one embodiment described herein. Here, two connectors 110A and 110B may be operably coupled to packages 151A and 151B respectively. Connectors 110A and 110B may also be operably coupled to waveguide bundle 130. Waveguide bundle 130 may use a variety of external waveguides such as 132A to operably connect connector 110A to connector 110B. This connection may allow a signal generated in package 151A to travel, propagate, or be transmitted through the waveguides (not shown) within the housing 120A of connector 110, into and through external waveguides, into and through the waveguides (not shown) within the housing 120B of connector 110B into package 151B. Advantageously, such a signal propagation may be performed without bending package 151A, waveguide bundle 130 or package 151B.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

What is claimed is:

1. A waveguide connector to operably couple one or more package excitation elements to at least one external waveguide, comprising:

a plurality of waveguides at least partially contained within a housing, each waveguide having a first end operably coupleable to a respective one of said one or more package excitation elements, and a second end operably coupleable to a respective one of said at least one external waveguides, said first and second ends being connected by walls, wherein:

said first end of each waveguide aligns with a first plane, and said second end of each waveguide aligns with a second plane disposed at an angle measured with respect to the first plane; and the plurality of waveguides is arranged in a two-dimensional waveguide array comprising a plurality of vertically stacked one-dimensional waveguide arrays at least partially contained within the housing; and wherein each of the plurality of vertically stacked one-dimensional arrays is offset horizontally from the waveguides of an adjacent one of the plurality of vertically stacked one-dimensional arrays.

2. A method of fabricating a waveguide connector, said method comprising:

forming a plurality of waveguides arranged in a two-dimensional waveguide array comprising a plurality of vertically stacked one-dimensional waveguide arrays at least partially contained within a housing, wherein any one of the plurality of vertically stacked one-dimensional arrays is offset horizontally from the waveguides of an adjacent one of the plurality of vertically stacked one-dimensional arrays, wherein each of the plurality of waveguides comprises a curved segment between a first straight segment and a second straight segment, the curved segment having a curvature, and wherein the first straight segment, the curved segment and the second straight segment are in the housing, said method of fabricating comprising:

depositing a conductive base layer;

subsequent to depositing the conductive base layer, depositing at least one sacrificial member comprising a sacrificial material adjacent to the conductive base layer, the at least one sacrificial member including at least:

a first end coincident with a first plane;

a second end coincident with a second plane, the second plane disposed at an angle measured with respect to the first plane; and a peripheral surface on the conductive base layer, the peripheral surface being curved and coupling the first end with the second end; and depositing a second conductive layer about at least a portion of the peripheral surface of the at least one sacrificial member thereby forming the plurality of waveguides.

3. The method of claim 2, further comprising removing at least a portion of the sacrificial material and then at least partially filling at least one of the plurality of waveguides with a dielectric material.

4. The method of claim 2, wherein said depositing the conductive base layer or the at least one sacrificial member is performed using three-dimensional (3D) printing or direct metal laminating.

5. A waveguide connector to operably couple one or more package excitation elements to at least one external waveguide, comprising:

a plurality of waveguides at least partially contained within a housing, each waveguide having a first end operably coupleable to a respective one of the one or more package excitation elements, and a second end operably coupleable to a respective one of said at least one external waveguides, said first and second ends being connected by walls, each waveguide comprising a curved segment between a first straight segment and a second straight segment, the curved segment having a curvature, and wherein the first straight segment, the curved segment and the second straight segment are in the housing, wherein:

the plurality of waveguides are arranged in a two-dimensional waveguide array comprising a plurality of vertically stacked one-dimensional waveguide arrays at least partially contained within the housing;

any one of the plurality of vertically stacked one-dimensional arrays is offset horizontally from the waveguides of an adjacent one of the plurality of vertically stacked one-dimensional arrays; and said first end of each waveguide aligns with a first plane, and said second end of each waveguide aligns with a second plane disposed at an angle measured with respect to the first plane.

6. The waveguide connector of claim 5, further comprising:

housing connection features enabling the waveguide connector to operably couple to at least one of a package or the at least one external waveguide; and waveguide connection features enabling at least one waveguide of the plurality of waveguides to operably couple to at least one of the one or more package excitation elements or the at least one external waveguide.

7. The waveguide connector of claim 6, wherein the housing connection features or the waveguide connection features comprise at least one of:

mechanical connection features;

chemical connection features;

thermal connection features; or electromagnetic connection features.

8. The waveguide connector of claim 5, wherein the walls of the plurality of waveguides are conductive and the walls comprise at least one of: metal walls or composite walls.

9. The waveguide connector of claim 5, wherein the plurality of waveguides are configured to operate at a millimeter-wave or sub-Terahertz frequency.

10. The waveguide connector of claim 5, wherein the housing comprises at least one of: a metal housing; a plastic housing; or a composite material housing.

11. A method of fabricating a waveguide connector, said method of fabricating the waveguide connector comprising:

forming a plurality of waveguides arranged in a two-dimensional waveguide array comprising a plurality of vertically stacked one-dimensional waveguide arrays at least partially contained within a housing, wherein any one of the plurality of vertically stacked one-dimensional arrays is offset horizontally from the waveguides of an adjacent one of the plurality of vertically stacked one-dimensional arrays, and wherein each waveguide comprises a curved segment between a first straight segment and a second straight segment, the curved segment having a curvature, and wherein the first straight segment, the curved segment and the second straight segment are in the housing, said method comprising:

forming a base housing layer, said base housing layer having a plurality of grooves formed therein, each of the plurality of grooves including at least:

a first end coincident with a first plane;

a second end coincident with a second plane, the second plane disposed at an angle measured with respect to the first plane; and depositing a conductive material on at least a portion of curved surfaces forming the plurality of grooves;

at least partially filling each of the plurality of grooves with a sacrificial material;

depositing a conductive layer at least partially over the surface of the sacrificial material of each respective one of the plurality of grooves, each of the conductive layers conductively coupled to the conductive material deposited on the portion of the surfaces forming the respective grooves thereby forming the plurality of waveguides; and forming a top housing layer.

12. The method of claim 11, wherein forming the base housing layer comprises forming the base housing layer using three-dimensional (3D) printing.

13. The method of claim 11, further comprising removing at least a portion of the sacrificial material.

14. The method of claim 13, further comprising at least partially filling at least one of the plurality of waveguides with a dielectric material after removing the at least the portion of the sacrificial material.

15. A waveguide transmission system comprising:

a package comprising a substrate and a plurality of excitation elements, wherein the package comprises an organic material package and a plurality of conductive traces; and a waveguide connector operably coupleable to said substrate and operably coupleable to a waveguide bundle, said waveguide connector comprising a housing and a plurality of waveguides at least partially contained within said housing, wherein each of the plurality of waveguides comprises:

a curved segment between a first straight segment and a second straight segment, the curved segment having a curvature, and wherein the first straight segment, the curved segment and the second straight segment are in the housing;

a first end operably coupleable to the plurality of excitation elements in the package;

a second end operably coupleable to one of a plurality of external waveguides; and walls connecting said first end to said second end.

16. The waveguide transmission system of claim 15, wherein the plurality of waveguides are to operate at the mm-wave or sub-THz frequencies.

17. The waveguide transmission system of claim 15, wherein at least one of the plurality of waveguides is at least partially hollow.

18. The waveguide transmission system of claim 15, wherein the housing comprises at least one of: a metal housing; a plastic housing; or a composite material housing.

19. The waveguide transmission system of claim 15, wherein the plurality of waveguides are all of a similar length.

* * * * *